US008587286B2

(12) United States Patent
Inoue et al.

(10) Patent No.: US 8,587,286 B2
(45) Date of Patent: Nov. 19, 2013

(54) REGULATOR CIRCUIT AND RFID TAG INCLUDING THE SAME IN WIRELESS COMMUNICATION TO IMPROVE NOISE MARGIN

(75) Inventors: Hiroki Inoue, Kanagawa (JP); Kiyoshi Kato, Kanagawa (JP); Shuhei Nagatsuka, Kanagawa (JP); Koichiro Kamata, Kanagawa (JP); Tsutomu Murakawa, Kanagawa (JP); Takahiro Tuji, Kanagawa (JP); Kaori Ikada, Tochigi (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 366 days.

(21) Appl. No.: 12/686,579

(22) Filed: Jan. 13, 2010

(65) Prior Publication Data

US 2010/0181985 A1 Jul. 22, 2010

(30) Foreign Application Priority Data

Jan. 16, 2009 (JP) ..... 2009-007207

(51) Int. Cl.
*G05F 3/16* (2006.01)
*G05F 1/00* (2006.01)

(52) U.S. Cl.
USPC ..... 323/315; 323/270; 323/281

(58) Field of Classification Search
USPC ..... 323/311, 312, 314, 315, 317, 270, 273, 323/280, 281
See application file for complete search history.

(56) References Cited

U.S. PATENT DOCUMENTS

| | | | | |
|---|---|---|---|---|
| 5,732,028 | A | 3/1998 | Shin | |
| 6,831,299 | B2 | 12/2004 | Koyama | |
| 6,975,489 | B2 * | 12/2005 | Otsuka et al. | 361/15 |
| 7,071,770 | B2 * | 7/2006 | Jung | 327/543 |
| 7,081,661 | B2 | 7/2006 | Takehara et al. | |
| 7,125,744 | B2 | 10/2006 | Takehara et al. | |
| 7,208,763 | B2 | 4/2007 | Koyama | |
| 7,255,283 | B2 | 8/2007 | Akaida et al. | |

(Continued)

FOREIGN PATENT DOCUMENTS

| | | | |
|---|---|---|---|
| CN | 1378420 | A | 11/2002 |
| CN | 101174823 | A | 5/2008 |

(Continued)

OTHER PUBLICATIONS

Machine translation of JP2008-165286: Takahashi et al, Constant-voltage circuit and semiconductor device equipped with the same, Jul. 7, 2008; 165286(1), 165286(2), and 165286(2continued).*

(Continued)

*Primary Examiner* — Adolf Berhane
*Assistant Examiner* — Emily Pham
(74) *Attorney, Agent, or Firm* — Husch Blackwell LLP

(57) ABSTRACT

One object of the present invention is to provide a regulator circuit with an improved noise margin. In a regulator circuit including a bias circuit generating a reference voltage on the basis of the potential difference between a first power supply terminal and a second power supply terminal, and a voltage regulator outputting a potential to an output terminal on the basis of a reference potential input from the bias circuit, a bypass capacitor is provided between a power supply terminal and a node to which a gate of a transistor included in the bias circuit is connected.

38 Claims, 10 Drawing Sheets

(56) References Cited

U.S. PATENT DOCUMENTS

| | | | | |
|---|---|---|---|---|
| 7,652,289 | B2 | 1/2010 | Koyama | |
| 7,663,447 | B2 | 2/2010 | Matsuzaki | |
| 7,667,539 | B2 * | 2/2010 | Li | 330/252 |
| 2002/0053671 | A1 | 5/2002 | Koyama | |
| 2003/0086278 | A1 | 5/2003 | Asami | |
| 2005/0024145 | A1 * | 2/2005 | Bocock et al. | 330/285 |
| 2005/0127365 | A1 | 6/2005 | Koyama | |
| 2005/0161508 | A1 | 7/2005 | Akaida et al. | |
| 2005/0180083 | A1 * | 8/2005 | Takahara et al. | 361/152 |
| 2006/0261796 | A1 * | 11/2006 | Park et al. | 323/312 |
| 2008/0150475 | A1 | 6/2008 | Kato et al. | |
| 2010/0117092 | A1 | 5/2010 | Koyama | |

FOREIGN PATENT DOCUMENTS

| | | |
|---|---|---|
| EP | 1 919 079 A1 | 5/2008 |
| JP | 9-179646 | 7/1997 |
| JP | 2002-246608 | 8/2002 |
| JP | 2003-44802 | 2/2003 |
| JP | 2008-181494 | 2/2003 |
| JP | 2003-141482 | 5/2003 |
| JP | 2003-168291 | 6/2003 |
| JP | 2005-242989 | 9/2005 |
| JP | 2008-165286 | 7/2008 |
| WO | WO 2006/080052 A1 | 8/2006 |

OTHER PUBLICATIONS

International Search report re application No. PCT/JP2009/071924, dated Apr. 6, 2010.

Written Opinion re application No. PCT/JP2009/071924, dated Apr. 6, 2010.

Jacob, B. et al, "21.2 Current Source Self-Biasing," *CMOS Circuit Design, Layout and Simulation*, IEEE Press, 1998, pp. 469-470.

Finkenzeller, K., "Principles and Applications of Non-Contact IC Cards," *RFID Handbook*, 2nd edition, Nikkan Kogyo Shimbun, Ltd., May 1, 2004, pp. 69-71 (with English translation, pp. 1-4).

Office Action re Chinese application No. CN 200980154959.8, dated May 28, 2013 (in Chinese).

* cited by examiner

REGULATOR CIRCUIT AND RFID TAG INCLUDING THE SAME IN WIRELESS COMMUNICATION TO IMPROVE NOISE MARGIN

TECHNICAL FIELD

This specification relates to a regulator circuit with an improved noise margin, and also relates to an RFID tag including the regulator circuit, which transmits and receives data through wireless communication.

BACKGROUND ART

In recent years, an environment where the information network is accessible anytime and anywhere has been developed as is called a ubiquitous information society. In such an environment, individual identification technologies have attracted attention. In these technologies, an identification (ID) number is assigned to each object so that the history of the object can be recognized to be utilized in production, management, or the like. Above all, semiconductor devices capable of wirelessly transmitting and receiving data have started to be used.

One of the individual identification technologies having attracted attention utilizes an RFID (radio frequency identification) tag as a semiconductor device that is capable of wirelessly transmitting, receiving, storing, and erasing data. The RFID tag is also called an IC (integrated circuit) tag, an RF tag, a wireless tag, an electronic tag, an IC chip, or a wireless chip. Data is transmitted and received to and from the RFID tag using a device for reading and writing data (hereinafter, referred to as a reader/writer). The individual identification technologies using the RFID tag have started to be used for production, management, or the like of an individual object, and application to personal authentication has also been promoted.

An RFID tag has an antenna for wirelessly transmitting and receiving electromagnetic waves, radio waves, or the like including data, and an integrated circuit as well as the antenna is included in the RFID tag. Some RFID tags generate, with use of a rectifier or a rectifier circuit included in the RFID tags, a DC voltage from electromagnetic waves, radio waves, or the like transmitted from an external device such as a reader/writer, and operate with a stable, constant voltage obtained through a controller such as a regulator circuit.

[Reference]

[Patent Document]

[Patent Document 1] Japanese Published Patent Application No. 2005-242989

[Patent Document 2] International Publication WO 2006/80052 Pamphlet

[Non-Patent Document]

[Non-Patent Document 1] Klaus Finkenzeller, *RFID Handbook: Fundamentals and Applications in Contactless Smart Cards and Identification* $2^{nd}$ *edition*, translated by SOFEL Co., Ltd. (The Nikkan Kogyo Shimbun, Ltd.) pp. 69-71

DISCLOSURE OF INVENTION

An RFD) tag usually operates without a power supply directly connected thereto because of its application mode. In such a case, some terminals connected to circuits in the RFID tag cannot be grounded, which can make the circuits extremely sensitive to high-frequency noise from the outside.

Particularly in a regulator circuit for stabilizing a DC potential generated in the RFID tag, the aforementioned high-frequency noise enters a node in the regulator circuit to adversely affect the circuit operation in some cases. As a result, the potential output from the regulator circuit becomes unstable and varies, leading to malfunction of the other circuits in the RFID tag which operate on the basis of the potential. Thus, it is desired that the regulator circuit in the RFID tag have an improved noise margin to be more resistant to high-frequency noise.

In view of the above problems, one object of the present invention is to provide a regulator circuit with an improved noise margin. It is another object of the present invention to improve the noise margin of an RFID tag by using the regulator circuit to increase the reliability of the RFID tag in communication.

In order to solve the above problems, the following measures are taken in an embodiment of this specification.

A regulator circuit includes a bias circuit generating a reference voltage, and a voltage regulator outputting a potential to an output terminal in accordance with the reference voltage. Particularly in the bias circuit, which is susceptible to the effect of high-frequency noise, a capacitor is provided between a node connected to a gate of a transistor forming the bias circuit and a reference potential wiring in an RFID tag. This capacitor serves as a bypass capacitor for mitigating high-frequency noise, so that the high-frequency noise that has entered the node connected to the gate of the transistor forming the bias circuit is bypassed to the reference potential side.

One embodiment in this specification is a regulator circuit including a first terminal, a second terminal having a potential difference from the first terminal, a bias circuit generating a reference potential on the basis of the potential difference, and a voltage regulator outputting a potential to an output terminal on the basis of the reference potential. The bias circuit includes a plurality of non-linear elements provided between the first terminal and the second terminal, and a bypass capacitor provided between one of the plurality of non-linear elements and one of the first terminal and the second terminal.

Another embodiment in this specification is a regulator circuit including: a first terminal; a second terminal having a potential difference from the first terminal; a bias circuit having first to fourth transistors, a resistor, and at least one bypass capacitor; and a voltage regulator electrically connected to the bias circuit. A gate of the first transistor is electrically connected to a gate of the second transistor, one of a source and a drain of the first transistor is electrically connected to the second terminal, and the other of the source and the drain of the first transistor is electrically connected to one of a source and a drain of the third transistor. One of a source and a drain of the second transistor is electrically connected to the second terminal, the other of the source and the drain of the second transistor is electrically connected to one of a source and a drain of the fourth transistor, and the gate of the second transistor is electrically connected to the other of the source and the drain of the second transistor. A gate of the third transistor is electrically connected to the other of the source and the drain of the fourth transistor, and the other of the source and the drain of the third transistor is electrically connected to the first terminal. A gate of the fourth transistor is electrically connected to the one of the source and the drain of the third transistor. One terminal of the resistor is electrically connected to the gate of the third transistor, and the other terminal of the resistor is electrically connected to the first terminal. The bypass capacitor is provided between a node connected to at least one of the gates of the first to fourth transistors and one of the first terminal and the second terminal.

In the above embodiments in this specification, the regulator circuit generates a reference potential on the basis of the potential difference between the first terminal and the second terminal.

Further, in the above embodiments in this specification, the voltage regulator outputs a potential to an output terminal on the basis of the reference potential generated by the regulator circuit.

Moreover, in the above embodiments in this specification, the bypass capacitor prevents a change in the potential of the gate connected to the node where the bypass capacitor is provided.

Still another embodiment in this specification is an RFID tag including a semiconductor integrated circuit provided with the aforementioned regulator circuit, a support provided at least over a surface of the semiconductor integrated circuit, and a shield provided at least over the surface of the semiconductor integrated circuit with the support interposed therebetween.

In the above embodiments in this specification, the bypass capacitor has a capacitance larger than parasitic capacitance generated between the node where the bypass capacitor is provided and the shield.

By employing the aforementioned structures, a regulator circuit with an improved noise margin is provided. In addition, the use of the regulator circuit results in an improvement in the noise margin of an RFID tag and further an increase in the reliability of the RFID tag in communication.

BEST MODE FOR CARRYING OUT THE INVENTION

Figure 1A:
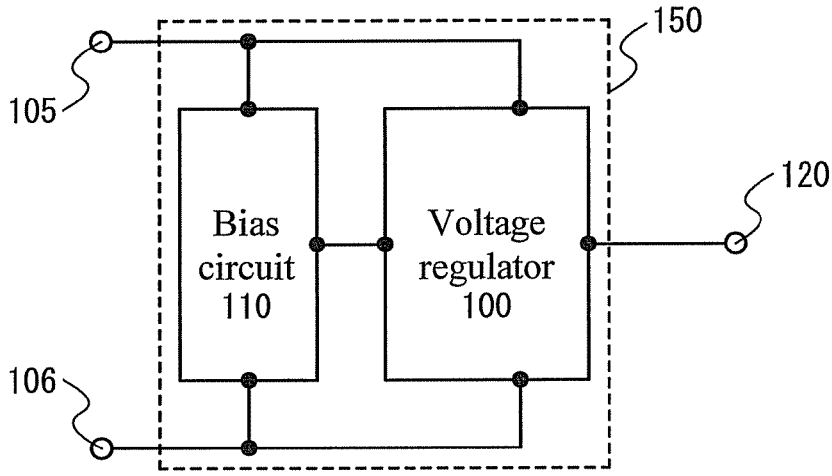
FIGS. 1A and 1B are diagrams illustrating an example of a configuration of a regulator circuit.

Embodiments of the invention will be described in detail below with reference to drawings. Note that in the structures of the embodiments shown below, like portions or portions having a similar function are denoted by like reference numerals in different drawings, and the description thereof is omitted in some cases.

(Embodiment 1)

An example of a configuration of a regulator circuit in this embodiment will be described with reference to FIGS. 1A and 1B.

As illustrated in FIG. 1A, a regulator circuit 150 disclosed in this embodiment includes a voltage regulator 100 and a bias circuit 110.

A reference power supply terminal 106 is a terminal to which a potential as a reference of a power supply voltage applied to the circuit illustrated in FIG. 1A is applied. In general, 0 V is applied to the reference power supply terminal 106, though other voltages may also be applied thereto because the potential applied to the reference power supply terminal 106 is only a reference of the power supply voltage of the circuit.

To an input power supply terminal 105, a potential obtained by using the potential of the reference power supply terminal 106 as a reference is applied.

The bias circuit 110 generates a potential $V_{REF}$ as a reference potential of the voltage regulator 100 in accordance with a voltage applied between the input power supply terminal 105 and the reference power supply terminal 106.

On the basis of the voltage applied between the input power supply terminal 105 and the reference power supply terminal 106, and the reference potential $V_{REF}$ generated by the bias circuit 110, the voltage regulator 100 outputs, from an output terminal 120, a potential higher or lower than that of the reference power supply terminal 106 by a predetermined voltage or a potential having a predetermined constant voltage with respect to that of the second terminal.

A load such as an arithmetic circuit is connected to a subsequent stage of the output terminal 120, and the load operates on the basis of a voltage applied between the output terminal 120 and the reference power supply terminal 106.

As the power consumption of the load increases, charges are consumed more to run short in the output terminal 120, which might cause a voltage drop at the output terminal 120. At this time, the voltage regulator 100 operates so that the potential of the output terminal 120 is raised to be kept at an initial constant value (a value before the power consumption of the load increases).

On the other hand, as the power consumption of the load decreases, excess charges are accumulated in the output terminal 120, which might cause a voltage rise at the output terminal 120. At this time, the voltage regulator 100 operates so that the potential of the output terminal 120 is lowered to be kept at an initial constant value (a value before the power consumption of the load decreases).

Note that, even though the potential is described as "constant", the output potential actually varies more or less depending on the characteristics of transistors forming the voltage regulator, or the amount of change in the power consumption of the load. Here, the output potential is described as "constant" unless the change in potential apparently affects circuit operation.

Note that there is no particular limitation on the configuration of the voltage regulator 100 in this embodiment. The voltage regulator 100 may have any configuration, provided the change in the potential of the output terminal 120 can be controlled in the aforementioned manner and a constant potential can be output to the output terminal 120 in accordance with the reference potential $V_{REF}$.

Figure 1B:
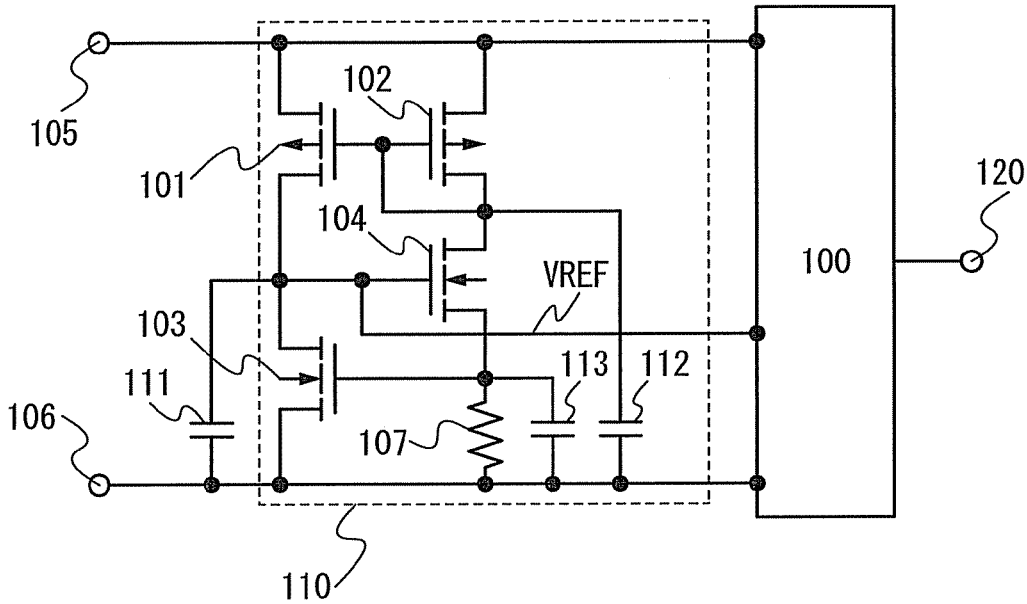

As illustrated in FIG. 1B, the bias circuit 110 includes transistors 101 to 104 and a resistor 107. In the example of FIG. 1B, the transistor 101 and the transistor 102 are p-type transistors, and the transistor 103 and the transistor 104 are n-type transistors.

The operation of the regulator circuit of this embodiment illustrated in FIGS. 1A and 1B, particularly the operation of the bias circuit 110 will be described below in detail.

In the bias circuit 110, a source of the transistor 101 and a source of the transistor 102 are electrically connected to the input power supply terminal 105, and a gate of the transistor 101 and a gate of the transistor 102 are electrically connected to each other, thereby forming a current mirror. Accordingly, the value of current flowing through the transistor 101 is equal to that flowing through the transistor 102. In addition, the gate of the transistor 102 is electrically connected to a drain of the transistor 102.

All the current flowing through the transistor 101 flows through the transistor 103, and all the current flowing through the transistor 102 flows through the resistor 107 via the transistor 104. At this time, a voltage generated between the two terminals of the resistor 107 is equal to a gate-source voltage (hereinafter, referred to as $V_{gs}$) of the transistor 103. Accordingly, the value of current flowing through the current mirror is determined by the relationship between the current flowing through the transistor 103 and the current flowing through the resistor 107, and corresponds to a value at which the value of current flowing through the transistor 103 is equal to that flowing through the resistor 107.

The transistor 104 is provided to secure the operation of the transistor 103 in a saturation region. All the current flowing through the transistor 102 flows through the resistor 107 via the transistor 104. At this time, a voltage corresponding to that current, namely, $V_{gs}$ of the transistor 104 is generated between a gate and a source of the transistor 104.

As for the state of the transistor 103 at this time, a voltage generated between the two terminals of the resistor 107 in accordance with a current flowing through the resistor 107 is applied between a gate and a source of the transistor 103. At the same time, a voltage equal to $V_{gs}$ of the transistor 104 is applied between the gate and a drain of the transistor 103. Accordingly, $|V_{gs}-V_{th}|\leq|V_{ds}|$ is always satisfied in the transistor 103 to secure the operation of the transistor 103 in a saturation region (here, $V_{th}$ represents the threshold voltage of the transistor and $V_{ds}$ represents the source-drain voltage of the transistor).

Furthermore, when the potential of the input power supply terminal 105 rises with respect to the reference power supply terminal 106, the transistor 104 operates in a saturation region and $V_{ds}$ thereof changes, so that $V_{REF}$ is not affected by a voltage change due to the above potential rise.

Through the above operation, a constant potential is output as $V_{REF}$ regardless of the change in the potential of the input power supply terminal 105 with respect to the reference power supply terminal 106.

In the bias circuit 110, $V_{REF}$ is determined by the relationship between the current flowing through the transistors 101 to 104 and the current flowing through the resistor 107, and thus is sensitive to a change in the operation state of the transistors. Since a transistor is an amplifying element, when the potential of the gate of the transistor slightly changes, a small amount of change in $V_{gs}$ is amplified to a large amount of change in the value of current flowing between the source and the drain. In other words, $V_{REF}$ considerably varies with a change in the potential of the gates of the transistors 101 to 104 due to noise from the outside. As a result, the potential output from the voltage regulator 100 changes, leading to malfunction of a logic circuit and the like connected to a subsequent stage.

In order to avoid that problem, capacitors 111 to 113 are respectively provided between the reference power supply terminal 106 and a node to which the gate of the transistor 104 is connected, between the reference power supply terminal 106 and a node to which the gates of the transistors 101 and 102 are connected, and between the reference power supply terminal 106 and a node to which the gate of the transistor 103 is connected.

By providing the capacitors 111 to 113, a change in the potential of the gates of the transistors 101 to 104 can be prevented even when noise enters from the outside. In this specification, a capacitor having such a function is referred to as a bypass capacitor. The bypass capacitor allows the voltage regulator 100 to output a stable potential, and a logic circuit and the like connected to a subsequent stage to operate stably.

As illustrated in FIG. 1B, the capacitors 111 to 113 are provided for all of the nodes to which the gates of the transistors 101 and 102, the gate of the transistor 103, and the gate of the transistor 104 are connected; however, a similar effect can be obtained even when one of the capacitors is provided. For example, only the capacitor 111, only the capacitor 112, or only the capacitor 113 may be provided. If two capacitors are provided, the capacitor 111 and the capacitor 112, or the capacitor 112 and the capacitor 113 may be provided in combination.

In particular, the value of current flowing to the node to which the gate of the transistor 104 is connected, which is the node to which $V_{REF}$ is output, significantly varies with a slight change in the potential of the gate of the transistor 101 or 103 that is an amplifying element; thus, this node is more sensitive to noise as compared to the other nodes. Therefore, the capacitor 111 provided for this node has a more significant effect than the capacitor 112 and the capacitor 113 provided for the other nodes.

Note that the capacitance of each of the capacitors 111 to 113 may be set to a value much larger than the parasitic capacitance of each node, though excessive capacitance might affect the operation rate of the circuit, which requires attention. For example, if the capacitor 111 has excessive capacitance, the capacitance between the gate and the source of the transistor 104 increases, leading to a reduction in the rate at which the gate of the transistor 104 is charged and discharged by the transistor 101 and the transistor 103. If the capacitor 113 has excessive capacitance, the capacitance between the gate and the source of the transistor 103 increases, leading to a reduction in the rate at which the gate of the transistor 103 is charged and discharged by the transistor 102, the transistor 104, and the resistor 107.

On the other hand, when the capacitance of the capacitor 112 increases, the capacitive coupling between the reference power supply terminal 106 and the gates of the transistors 101 and 102 has a considerable influence. Thus, the potential difference between the reference power supply terminal 106 and the input power supply terminal 105 starts to increase in the regulator circuit 150. At the beginning of the increase, the potential of the sources of the transistor 101 and the transistor 102 increases with an increase in the potential of the input power supply terminal 105; at the same time, the potential difference between the gate of the transistor 102 and the reference power supply terminal 106 is tried to be kept constant by the capacitor 112 with use of the capacitive coupling between the reference power supply terminal 106 and the gates of the transistors 101 and 102. Accordingly, at the beginning of the increase in the potential difference between the reference power supply terminal 106 and the input power supply terminal 105, namely, early in the operation of the RFID tag, the capacitor 112 promotes an increase in $V_{gs}$ of the transistor 101 and the transistor 102, and thus contributes to a rapid rise in a power supply potential in the RFID tag early in the operation.

(Embodiment 2)

An RFID tag usually operates without a power supply directly connected thereto because of its application mode. In such a case, some terminals connected to circuits in the RFID tag cannot be grounded, which makes it difficult to take countermeasures against static electricity by utilizing grounding. In this embodiment, an example of countermeasures against static electricity in an RFID tag will be shown.

Figure 2A:
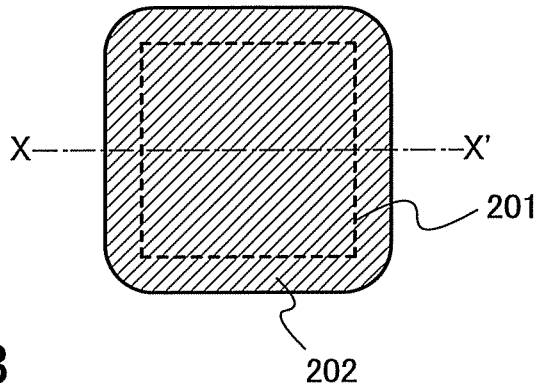
FIGS. 2A to 2C are diagrams illustrating an example of countermeasures against static electricity in an RFID tag.

FIG. 2A is a top view of an RFID tag. A semiconductor integrated circuit 201 includes a regulator circuit and circuits having a function as an RFID tag, such as a rectifier circuit, a modulation circuit, a demodulation circuit, and other logic circuits. The semiconductor integrated circuit 201 is covered with a support 202. Furthermore, a shield 203 that is a thin film made of a conductive material is provided on the outside of the support, thereby protecting the elements included in the semiconductor integrated circuit 201 against electrostatic discharge.

Figure 2B:
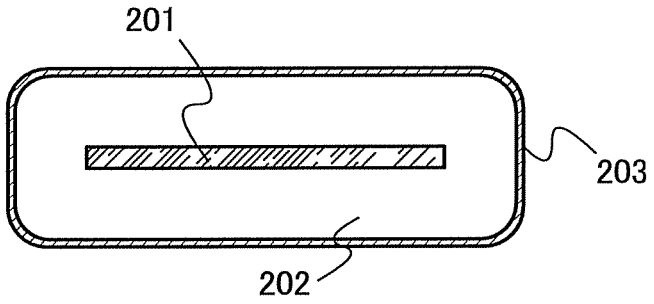

FIG. 2B is a cross-sectional view along line X-X' of FIG. 2A. The semiconductor integrated circuit 201 has a thin-plate shape and includes elements such as a transistor, a resistor, and a capacitor formed on a surface of a substrate. The support 202 is formed to cover the front, back, and side surfaces of the semiconductor integrated circuit 201. The substrate used for the semiconductor integrated circuit 201 can be made of various materials such as glass, plastic, or silicon. In the case where glass or plastic is used for the substrate, the substrate may be subjected to polishing or the like to be extremely thin and have bending properties.

The support 202 is provided mainly to protect the surface of the semiconductor integrated circuit 201, increase the mechanical strength of the semiconductor integrated circuit 201, and protect the semiconductor integrated circuit 201 against bending stress. Although the support 202 is provided to cover all of the front, back, and side surfaces of the semiconductor integrated circuit 201 in this embodiment, it may be provided only on the front surface of the semiconductor integrated circuit 201, or on the front and back surfaces thereof to sandwich the semiconductor integrated circuit 201. As the support 202, a resin thin film may be used, or a structural body in which a fibrous body is impregnated with a resin may be used to increase the mechanical strength of the support 202.

The shield 203 is formed using a thin film made of a conductive material and provided on the surface of the support 202. The shield 203 allows charges to rapidly diffuse when electrostatic discharge occurs, thereby preventing the electrostatic breakdown of the semiconductor integrated circuit 201. Although the shield 203 is provided to cover all of the front, back, and side surfaces of the support 202 in FIG. 2B, it may be provided only on the front surface of the support 202, or on the front and back surfaces thereof to sandwich the support 202. In the case where the shield 203 is provided only on the front surface of the support 202, it is preferably provided on a side closer to the surface of the semiconductor integrated circuit 201 over which the elements are formed. Further, the shield 203 may be formed, as illustrated in FIG. 2B, using a thin film covering the entire surface of the support 202, or may be formed using island-like structural bodies made of a conductive material that dot the surface of the support 202.

Note that the shield 203 is preferably formed thin enough not to interfere with the communication between a reader/writer and the RFID tag.

Figure 2C:
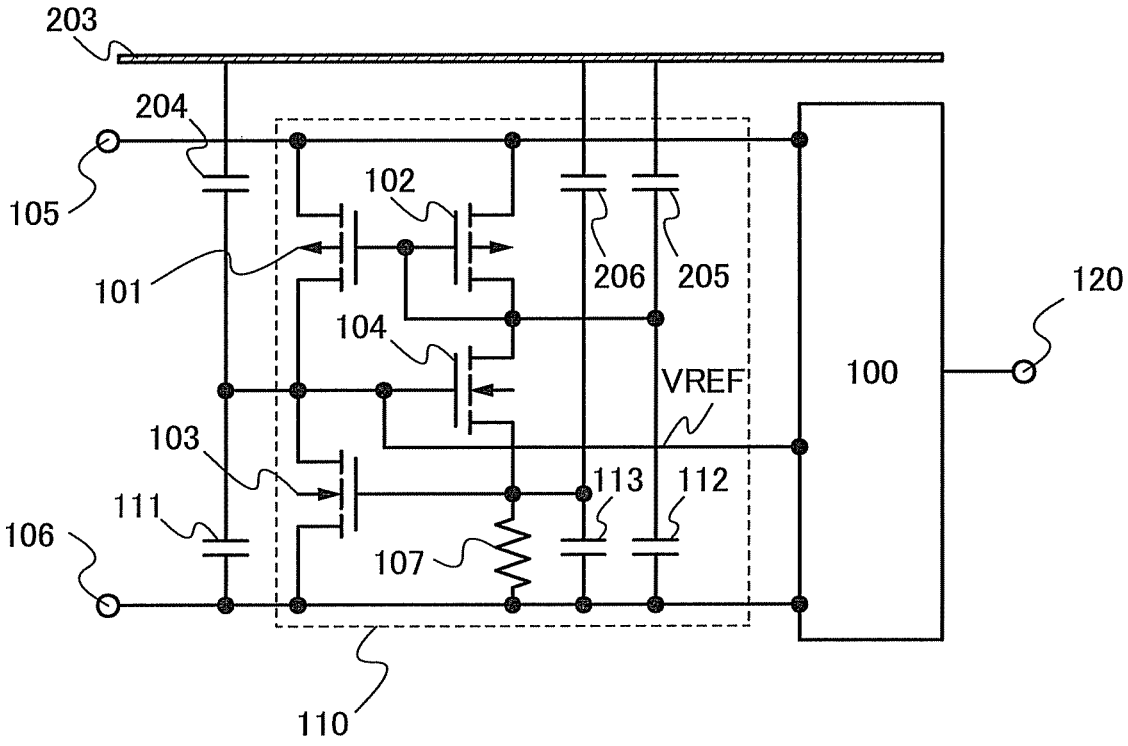

In the RFID tag illustrated in FIGS. 2A and 2B, in which the countermeasures against static electricity are taken, parasitic capacitance using the support 202 as a dielectric is generated between each part of the circuits included in the semiconductor integrated circuit 201 and the shield 203. FIG. 2C illustrates this case. The bias circuit 110 includes the transistors 101 to 104, and for example, parasitic capacitance 204 is generated between the shield 203 and the node to which the gate of the transistor 104 is connected, parasitic capacitance 205 is generated between the shield 203 and the node to which the gates of the transistors 101 and 102 are connected, and parasitic capacitance 206 is generated between the shield 203 and the node to which the gate of the transistor 103 is connected.

The parasitic capacitance 204 to 206 is respectively generated at the nodes to which the gate of the transistor 104, the gates of the transistors 101 and 102, and the gate of the transistor 103 are connected. When noise enters from the outside through the shield 203, the potentials of the gates of the transistors 101 to 104 are likely to change due to capacitive coupling caused by the parasitic capacitance 204 to 206.

In order to avoid that problem, as shown in Embodiment 1, the capacitors 111 to 113 are provided for the nodes to which the gates of the transistors are connected, thereby preventing a change in the potential of each gate of the transistors caused by the aforementioned noise entering from the outside. Thus, the regulator circuit including the bias circuit 110 and the voltage regulator 100 can output a stable potential. As a result, stable operation of the RFID tag using the output potential of the regulator circuit as a power supply potential, that is, an increase in the noise margin of the RFID tag can be achieved.

(Embodiment 3)

Figure 3:
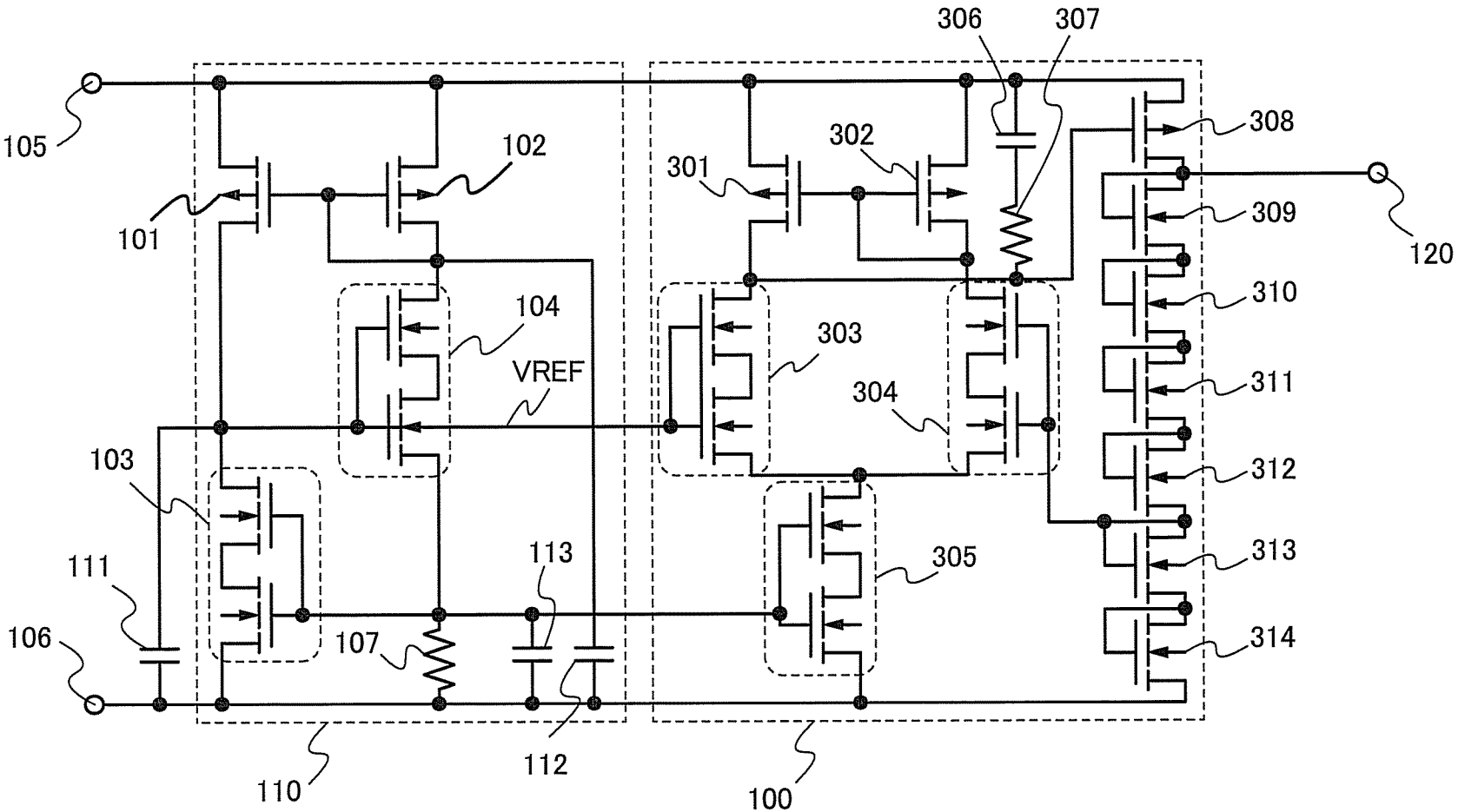
FIG. 3 is a diagram illustrating an example of a configuration of a regulator circuit.

FIG. 3 illustrates an example of a configuration of the voltage regulator included in the regulator circuit shown in Embodiment 1. The bias circuit 110 has a configuration similar to that described in Embodiment 1. In FIG. 3, double-gate transistors are used as the transistor 103 and the transistor 104; however, single-gate transistors may be used as in Embodiment 1 or multi-gate transistors having three or more gates may also be used.

The voltage regulator 100 includes a differential amplifier circuit having transistors 301 to 305, a divider circuit having transistors 309 to 314, and an output control transistor that is a p-type transistor 308. The differential amplifier circuit includes a current mirror formed by the transistor 301 and the transistor 302, a differential pair formed by the transistor 303 and the transistor 304, and a current source formed by the transistor 305. A feedback circuit includes the p-type transistor 308 and the divider circuit formed by the n-type transistors 309 to 314 each of which is diode-connected.

In the differential amplifier circuit, a reference potential $V_{REF}$ output from the bias circuit 110 is input to a gate of the transistor 303 that is one of the differential pair, and negative feedback is applied to a gate of the transistor 304, which is the other of the differential pair, via the p-type transistor 308 and part of the divider circuit, whereby the output of the differential amplifier circuit is stabilized.

A capacitor 306 and a resistor 307 are also provided to stabilize the output of the differential amplifier circuit. Note that, if a heavy load is connected to a subsequent stage of the output terminal 120 or the electric power of the load varies largely, a storage capacitor may be provided for the output terminal 120.

Note that the configurations of both the voltage regulator 100 and the bias circuit 110 shown in this embodiment are just examples, and are not limited to those described in this embodiment.

(Embodiment 4)

In this embodiment, an example of a method for manufacturing the semiconductor integrated circuit described in the above embodiments will be described.

Figure 5A:
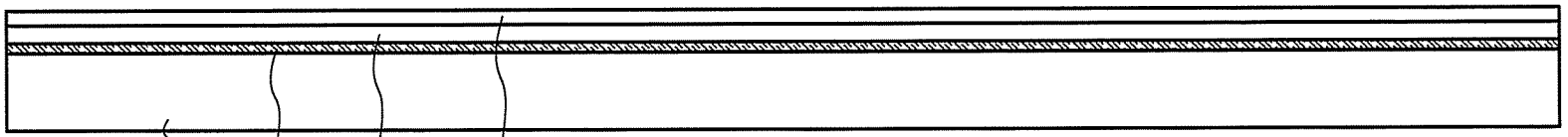
FIGS. 5A to 5C are diagrams illustrating an example of a method for manufacturing a semiconductor integrated circuit.

First, a separation layer 1202 is formed on a surface of a substrate 1201, and an insulating film 1203 serving as a base film and a semiconductor film 1204 (e.g., a film containing amorphous silicon) are stacked thereover (see FIG. 5A). The separation layer 1202, the insulating film 1203, and the semiconductor film 1204 can be formed successively, whereby they can be formed without exposure to air and thus entering of impurities can be prevented.

As the substrate 1201, a glass substrate, a quartz substrate, a metal substrate, a stainless steel substrate, a plastic substrate having heat resistance high enough to withstand processing temperatures in the process, or the like may be used. Such a substrate is not particularly limited in area and shape; therefore, by using, for example, a rectangular substrate with a side of 1 meter or longer, productivity can be significantly increased. This is a major advantage as compared to the case of using a circular silicon substrate. Thus, even when a circuit portion occupies a larger area, production cost can be reduced as compared to the case of using a silicon substrate.

Note that the separation layer 1202 is provided on the entire surface of the substrate 1201 in this process, though it may be selectively provided as needed by photolithography. In addition, although the separation layer 1202 is formed in contact with the substrate 1201 in this process, an insulating film such as a silicon oxide film, a silicon oxynitride film, a silicon nitride film, or a silicon nitride oxide film may be formed in contact with the substrate 1201 as needed, and the separation layer 1202 may be formed in contact with the insulating film.

Here, oxynitride refers to a substance that contains more oxygen than nitrogen, and nitride oxide refers to a substance that contains nitrogen than oxygen. For example, silicon oxynitride is a substance containing oxygen, nitrogen, silicon, and hydrogen at concentrations ranging from 50 atomic % to 70 atomic %, 0.5 atomic % to 15 atomic %, 25 atomic % to 35 atomic %, and 0.1 atomic % to 10 atomic %, respectively. Further, silicon nitride oxide is a substance containing oxygen, nitrogen, silicon, and hydrogen at concentrations ranging from 5 atomic % to 30 atomic %, 20 atomic % to 55 atomic %, 25 atomic % to 35 atomic %, and 10 atomic % to 30 atomic %, respectively. Note that the above concentration ranges are obtained when measurements are performed using Rutherford backscattering spectrometry (RBS) or hydrogen forward scattering (HFS). In addition, the total of the percentages of the constituent elements does not exceed 100 atomic %.

As the separation layer 1202, a metal film, a multi-layer structure of a metal film and a metal oxide film, or the like may be used. The metal film has a single-layer structure or a multi-layer structure of a film made of an element selected from tungsten (W), molybdenum (Mo), titanium (Ti), tantalum (Ta), niobium (Nb), nickel (Ni), cobalt (Co), zirconium (Zr), zinc (Zn), ruthenium (Ru), rhodium (Rh), palladium (Pd), osmium (Os), and iridium (Ir), an alloy containing any of these elements as its main component, or a compound containing any of these elements as its main component. The film containing these materials can be formed by sputtering or various CVD methods such as plasma CVD. As the multi-layer structure of a metal film and a metal oxide film, after the aforementioned metal film is formed, oxide or oxynitride of the metal film can be formed on the surface of the metal film by performing plasma treatment in an oxygen atmosphere or an $N_2O$ atmosphere, or heat treatment in an oxygen atmosphere or an $N_2O$ atmosphere. Alternatively, after the metal film is formed, the surface of the metal film may be subjected to treatment with a highly oxidizing solution such as ozone water, whereby oxide or oxynitride of the metal film can be provided on the surface of the metal film.

The insulating film 1203 has a single-layer structure or a multi-layer structure of a film containing oxide of silicon or nitride of silicon formed by sputtering, plasma CVD, or the like. In the case where the insulating film serving as a base has a two-layer structure, for example, a silicon nitride oxide film may be formed as a first layer and a silicon oxynitride film may be formed as a second layer. In the case where the insulating film serving as a base has a three-layer structure, for example, a silicon oxide film, a silicon nitride oxide film, and a silicon oxynitride film may be formed as a first insulating layer, a second insulating layer, and a third insulating layer, respectively. Alternatively, a silicon oxynitride film, a silicon nitride oxide film, and a silicon oxynitride film may be formed as a first insulating layer, a second insulating layer, and a third insulating layer, respectively. The insulating film 1203 serving as a base functions as a blocking film to prevent impurities from entering from the substrate 1201.

The semiconductor film 1204 is formed by sputtering, LPCVD, plasma CVD, or the like to a thickness of about 25 nm to 200 nm, preferably, about 50 nm to 70 nm, and specifically, 66 nm. As the semiconductor film 1204, for example, an amorphous silicon film may be formed.

Next, the semiconductor film 1204 is irradiated with laser light to be crystallized. Note that the semiconductor film 1204 may be crystallized by combining laser light irradiation and thermal crystallization using RTA (rapid thermal annealing) or an annealing furnace, thermal crystallization using a metal element that promotes crystallization, or the like. Then, the obtained crystalline semiconductor film is etched into a desired shape, whereby a semiconductor film 1204*a* and a semiconductor film 1204*b* are formed.

An example of a manufacturing process of the semiconductor films 1204*a* and 1204*b* will be briefly described below. First, an amorphous semiconductor film (e.g., an amorphous silicon film) is formed by plasma CVD. After the amorphous semiconductor film is coated with a solution containing nickel that is a metal element promoting crystallization, the amorphous semiconductor film is subjected to dehydrogenation treatment (at 500° C. for one hour) and thermal crystallization treatment (at 550° C. for four hours), whereby a crystalline semiconductor film is formed. Then, the crystalline semiconductor film is irradiated with laser light from a laser oscillator as needed depending on the degree of crystallization. Furthermore, the semiconductor films 1204*a* and 1204*b* are formed by photolithography. Note that the thermal crystallization using a metal element that promotes crystallization is not necessarily conducted, and the amorphous semiconductor film may be crystallized only by laser light irradiation.

Alternatively, the semiconductor films 1204*a* and 1204*b* may be formed in such a manner that the semiconductor film is scanned in one direction for crystallization while being irradiated with continuous-wave laser light or laser light having a repetition rate of 10 MHz or more. In the case of such crystallization, crystals grow in the scanning direction of the laser light. A thin film transistor (TFT) may be placed so that the scanning direction is aligned with the channel-length direction (the direction in which carriers flow when a channel formation region is formed).

Figure 5B:
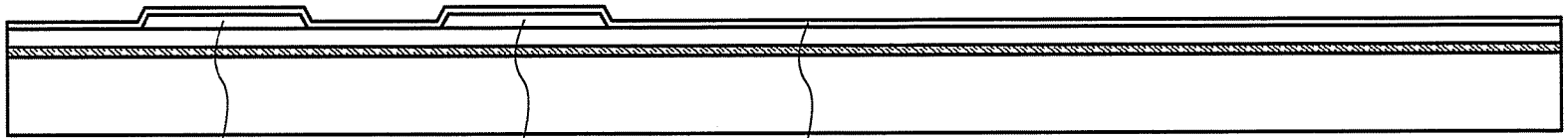

Next, a gate insulating film 1205 is formed to cover the semiconductor films 1204*a* and 1204*b* (see FIG. 5B). The gate insulating film 1205 has a single-layer structure or a multi-layer structure of a film containing oxide of silicon or nitride of silicon formed by CVD, sputtering, or the like. Specifically, the gate insulating film 1205 has a single-layer structure or a multi-layer structure of a silicon oxide film, a silicon oxynitride film, or a silicon nitride oxide film.

Alternatively, the gate insulating film 1205 may be formed by oxidizing or nitriding the surfaces of the semiconductor films 1204*a* and 1204*b* by plasma treatment. For example, the gate insulating film 1205 is formed by plasma treatment with a mixed gas of a rare gas such as He, Ar, Kr or Xe, and oxygen, nitrogen oxide ($NO_2$), ammonia, nitrogen, hydrogen, or the like. When plasma is excited by microwaves in that case, plasma with a low electron temperature and a high density can be generated. The surfaces of the semiconductor films can be oxidized or nitrided by oxygen radicals (that may include OH radicals) or nitrogen radicals (that may include NH radicals), which are generated by the high-density plasma.

By treatment with such high-density plasma, an insulating film with a thickness of about 1 nm to 20 nm, typically about 5 nm to 10 nm is formed on the surfaces of the semiconductor films. Since the reaction in that case is a solid-phase reaction, the interface state density between the insulating film and the semiconductor films can be significantly decreased. The semiconductor films (crystalline silicon or polycrystalline silicon) are directly oxidized (or nitrided) by such plasma treatment, whereby a variation in the thickness of the insulating film to be formed can be considerably reduced. In addition, oxidation does not proceed even at the crystal grain boundaries of crystalline silicon, which makes a very preferable condition. That is, by the solid-phase oxidation of the surfaces of the semiconductor films with the high-density plasma treatment described here, an insulating film with good uniformity and low-interface state density can be formed without excessive oxidation reaction at crystal grain boundaries.

As the gate insulating film 1205, only an insulating film formed by the plasma treatment may be used or an insulating film made of silicon oxide, silicon oxynitride, or silicon nitride may be additionally stacked thereover by CVD using plasma or thermal reaction. In any case, an insulating film formed by the plasma treatment is preferably included in part or the whole of the gate insulating film of the thin film transistor, so that a variation in the characteristics of the transistor can be reduced.

Furthermore, in the case where the semiconductor films 1204*a* and 1204*b* are formed in such a manner that the semiconductor film is scanned in one direction for crystallization while being irradiated with continuous-wave laser light or laser light having a repetition rate of 10 MHz or more, by using the gate insulating film formed by the plasma treatment in combination, a thin film transistor with a small variation in characteristics and high field-effect mobility can be obtained.

Next, a conductive film is formed over the gate insulating film 1205. Here, a single-layer conductive film with a thickness of about 100 nm to 500 nm is formed. The conductive film can be made of a material containing an element selected from tantalum (Ta), tungsten (W), titanium (Ti), molybdenum (Mo), aluminum (Al), copper (Cu), chromium (Cr), niobium (Nb), and the like, an alloy containing any of these elements as its main component, or a compound containing any of these elements as its main component. Alternatively, a semiconductor material typified by polycrystalline silicon doped with an impurity element such as phosphorus may be used. In the case where the conductive film has a multi-layer structure, for example, it is possible to use a multi-layer structure of a tantalum nitride film and a tungsten film, a multi-layer structure of a tungsten nitride film and a tungsten film, or a multi-layer structure of a molybdenum nitride film and a molybdenum film. For example, a multi-layer structure of a tantalum nitride film with a thickness of 30 nm and a tungsten film with a thickness of 150 nm can be used. Since tungsten and tantalum nitride have high heat resistance, heat treatment for thermal activation can be performed after the conductive film is formed. The conductive film may have a multi-layer structure of three or more layers, and for example, a multi-layer structure of a molybdenum film, an aluminum film, and a molybdenum film may be used.

Next, a resist mask is formed over the above conductive film by photolithography and etching is performed to form a gate electrode and a gate wiring, whereby a gate electrode 1207 is formed over the semiconductor films 1204*a* and 1204*b*.

Then, a resist mask is formed by photolithography and an impurity element imparting n-type or p-type conductivity is added to the semiconductor films 1204*a* and 1204*b* at low concentration by ion doping or ion implantation. In this embodiment, an impurity element imparting n-type conductivity is added to the semiconductor films 1204*a* and 1204*b* at low concentration. As the impurity element imparting n-type conductivity, an element belonging to Group 15 of the periodic table, for example, phosphorus (P) or arsenic (As) can be used. As the impurity element imparting p-type conductivity, an element belonging to Group 13 of the periodic table, for example, boron (B) can be used.

Although only the thin film transistors (n-type TFTs) to which an impurity element imparting n-type conductivity is added are shown in this embodiment for simplicity, one embodiment of the present invention is not limited to this structure. Only thin film transistors including a semiconductor film to which an impurity element imparting p-type conductivity is added (p-type TFTs) may be used, or n-type TFTs and p-type TFTs may be formed in combination. In the case where n-type TFTs and p-type TFTs are formed in combination, an impurity element imparting n-type conductivity is added using a mask covering a semiconductor film that is to be included in p-type TFTs, and an impurity element imparting p-type conductivity is added using a mask covering a semiconductor film that is to be included in n-type TFTs, whereby the impurity element imparting n-type conductivity and the impurity element imparting p-type conductivity can be selectively added.

Next, an insulating film is formed to cover the gate insulating film 1205 and the gate electrode 1207. The insulating film has a single-layer structure or a multi-layer structure of a film containing an inorganic material such as silicon, oxide of silicon, or nitride of silicon, or a film containing an organic material such as an organic resin, which is formed by CVD, sputtering, or the like. Then, the insulating film is selectively etched by anisotropic etching performed mainly in a perpendicular direction, whereby insulating films 1208 (also referred to as sidewalls) touching the side surfaces of the gate electrode 1207 are formed. The insulating films 1208 are used as masks when an impurity element is added later to form LDD (lightly doped drain) regions.

Figure 5C:
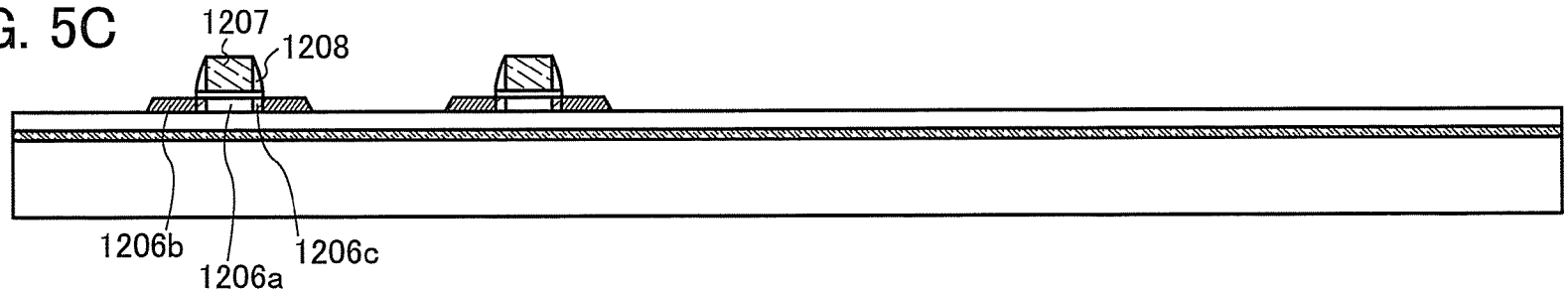

Next, an impurity element imparting n-type conductivity is added to the semiconductor films 1204*a* and 1204*b* with a resist mask formed by photolithography, the gate electrode 1207, and the insulating films 1208 used as masks. As a result, a channel formation region 1206*a*, first impurity regions 1206*b*, and second impurity regions 1206*c* are formed (see FIG. 5C). The first impurity regions 1206*b* serve as a source and a drain region of the thin film transistor, and the second impurity regions 1206*c* serve as LDD regions. The concentration of the impurity element contained in the second impurity regions 1206*c* is lower than that of the impurity element contained in the first impurity regions 1206*b*.

Then, an insulating film having a single-layer structure or a multi-layer structure is formed to cover the gate electrode 1207, the insulating films 1208, and the like. This embodiment shows an example in which the insulating film has a three-layer structure of an insulating film 1209, an insulating film 1210, and an insulating film 1211. These insulating films can be formed by CVD. For example, a silicon oxynitride film with a thickness of 50 nm, a silicon nitride oxide film with a thickness of 200 nm, and a silicon oxynitride film with a thickness of 400 nm can be formed as the insulating film 1209, the insulating film 1210, and the insulating film 1211, respectively. Surfaces of these insulating films are, although depending on the thicknesses thereof, formed along the surface of the layer provided therebelow. That is, since the insulating film 1209 is thin, its surface is almost along the surface of the gate electrode 1207. Since the surface of a film becomes flat as the thickness thereof increases, the insulating film 1211, which is the thickest among the three-layer structure, has an almost flat surface shape, though it is different from the flat surface shape of a film made of an organic material. In other words, in the case where a flat surface is formed, the insulating film may be formed of an organic material such as polyimide, polyamide, benzocyclobutene, acrylic, or epoxy, a siloxane material, or the like. These insulating films may be formed by sputtering, SOG, droplet discharging, screen printing, or the like in addition to CVD.

After the insulating films 1209, 1210, and 1211, and the like are etched by photolithography to form contact holes reaching the first impurity regions 1206*b*, conductive films 1231*a* serving as source and drain electrodes of the thin film transistors, and a conductive film 1231*b* serving as a connection wiring are formed. The conductive films 1231*a* and the conductive film 1231*b* can be formed by forming a conductive film so as to fill the contact holes and selectively etching the conductive film. Note that, before the conductive film is formed, silicide may be formed on the surfaces of the semiconductor films 1204*a* and 1204*b*, which are exposed in the contact holes, so that the resistance can be reduced.

The conductive films 1231*a* and the conductive film 1231*b* are preferably formed of a low resistance material in order to reduce signal delay. Since a low resistance material often has low heat resistance, a high heat resistance material is preferably provided over and below the low resistance material. For example, it is possible to use a structure in which a film of aluminum with a thickness of 300 nm is formed as a film of a low resistance material and a film of titanium with a thickness of 100 nm is provided over and below the aluminum film. The conductive film 1231*b* serving as the connection wiring can be formed to have the same stacked structure as the conductive films 1231*a*, so that the resistance of the connection wiring can be reduced and the heat resistance thereof can be improved. The conductive films 1231*a* and the conductive film 1231*b* can be formed to have a single-layer structure or a multi-layer structure using another conductive material, for example, a material containing an element selected from tungsten (W), tantalum (Ta), molybdenum (Mo), nickel (Ni), platinum (Pt), copper (Cu), gold (Au), silver (Ag), manganese (Mn), neodymium (Nd), carbon (C), and silicon (Si), an alloy containing any of these elements as its main component, or a compound containing any of these elements as its main component. The alloy containing aluminum as its main component corresponds to, for example, a material that contains aluminum as its main component and also contains nickel, or an alloy material that contains aluminum as its main component and also contains nickel and one or both of carbon and silicon. The conductive films 1231*a* and the conductive film 1231*b* can be formed by CVD, sputtering, or the like.

Figures 6A, 6B, 6C:
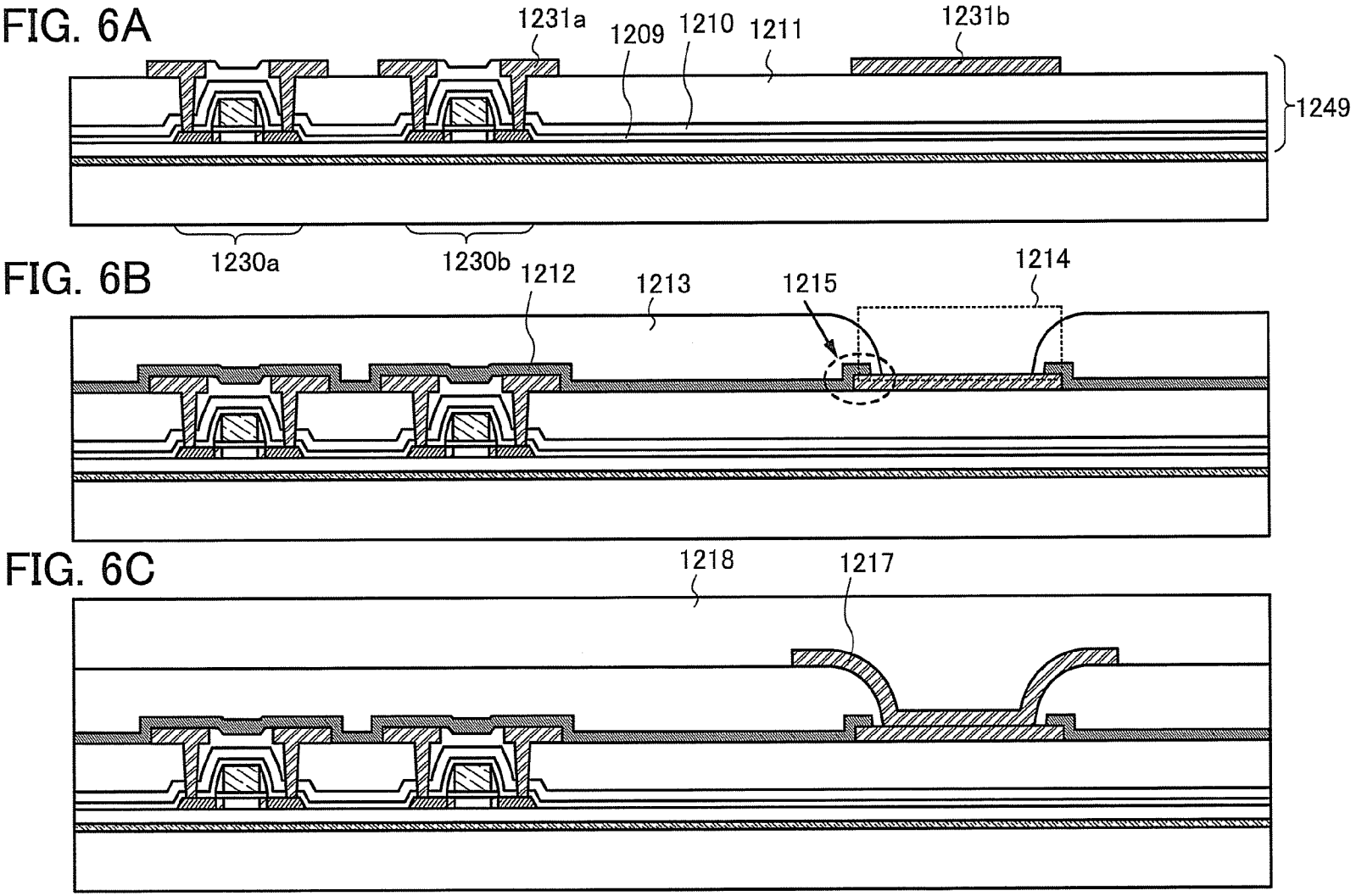
FIGS. 6A to 6C are diagrams illustrating an example of a method for manufacturing a semiconductor integrated circuit.

Through the above steps, an element layer 1249 including a thin film transistor 1230*a* and a thin film transistor 1230*b* is obtained (see FIG. 6A).

Note that, before the insulating films 1209, 1210, and 1211 are formed, or after the insulating film 1209 is formed or the insulating films 1209 and 1210 are formed, heat treatment is preferably performed to recover the crystallinity of the semiconductor films 1204*a* and 1204*b*, activate the impurity element added to the semiconductor films 1204*a* and 1204*b*, and hydrogenate the semiconductor films 1204*a* and 1204*b*. The heat treatment may be performed by thermal annealing, laser annealing, RTA, or the like.

Next, an insulating film 1212 and an insulating film 1213 are formed to cover the conductive films 1231*a* and 1231*b* (see FIG. 6B). A silicon nitride film with a thickness of 100 nm is used as the insulating film 1212 and a polyimide film with a thickness of 1500 nm is used as the insulating film 1213, for example. The surface shape of the insulating film 1213 is preferably as flat as possible. Accordingly, the flatness of the surface of the insulating film 1213 is increased by making the film to have a large thickness of, for example, 750 nm to 3000 nm (specifically, 1500 nm), as well as by using polyimide as an organic material. An opening is formed in the insulating films 1212 and 1213. This embodiment shows an example in which an opening 1214 is formed to expose the conductive film 1231*b*. In such an opening 1214 (specifically, in a region 1215 surrounded by a dotted line), an end portion of the insulating film 1212 is covered with the insulating film 1213. By covering the end portion of the insulating film 1212 as a lower layer with the insulating film 1213 as an upper layer, disconnection of a wiring formed later in the opening 1214 can be prevented. Since polyimide that is an organic material is used for the insulating film 1213 in this embodiment, the insulating film 1213 can be a gently tapered shape in the opening 1214 and disconnection can be efficiently prevented. As a material for the insulating film 1213, with which disconnection can be prevented, it is possible to use an organic material such as polyamide, benzocyclobutene, acrylic, or epoxy, a siloxane material, or the like in addition to polyimide. Further, as the insulating film 1212, a silicon oxynitride film or a silicon nitride oxide film may be used instead of the silicon nitride film. The insulating films 1212 and 1213 can be manufactured by CVD, sputtering, SOG, droplet discharging, screen printing, or the like.

Next, a conductive film 1217 is formed over the insulating film 1213, and an insulating film 1218 is formed over the conductive film 1217 (see FIG. 6C).

The conductive film 1217 can be made of the same material as the conductive films 1231*a* and 1231*b*. For example, the conductive film 1217 may have a multi-layer structure of a film of titanium with a thickness of 100 nm, a film of aluminum with a thickness of 200 nm, and a film of titanium of with a thickness of 100 nm. The conductive film 1217 is connected to the conductive film 1231*b* in the opening 1214; therefore, the titanium films are in contact with each other and the contact resistance can be reduced. The conductive film 1217 preferably has a low wiring resistance because a current based on a signal between the thin film transistor and an antenna (that is formed later) flows in the conductive film 1217. Accordingly, a low resistance material such as aluminum is preferably used. The conductive film 1217 can also be formed to have a single-layer structure or a multi-layer structure using another conductive material, for example, a material containing an element selected from tungsten (W), tantalum (Ta), molybdenum (Mo), nickel (Ni), platinum (Pt), copper (Cu), gold (Au), silver (Ag), manganese (Mn), neodymium (Nd), carbon (C), and silicon (Si), an alloy containing any of these elements as its main component, or a compound containing any of these elements as its main component. The alloy containing aluminum as its main component corresponds to, for example, a material that contains aluminum as its main component and also contains nickel, or an alloy material that contains aluminum as its main component and also contains nickel and one or both of carbon and silicon. The conductive film 1217 can be formed by CVD, sputtering, or the like.

The insulating film 1218 is preferably made of an organic material because it needs to have a flat surface. Here, a case of using a film of polyimide with a thickness of 2000 nm is shown as an example. The insulating film 1218 is formed to a thickness of 2000 nm, which is larger than the thickness of the insulating film 1213, so that the surface of the opening 1214 in the insulating film 1213 with a thickness of 1500 nm and the surface of the conductive film 1217 formed in the opening 1214 can be made flat. Therefore, the insulating film 1218 preferably has a thickness 1.1 to 2 times, preferably 1.2 to 1.5 times the thickness of the insulating film 1213. When the insulating film 1213 has a thickness of 750 nm to 3000 nm, the insulating film 1218 preferably has a thickness of 900 nm to 4500 nm. The insulating film 1218 is preferably formed of a material with which flatness can be increased, while taking into consideration the thickness of the insulating film 1218. As a material for the insulating film 1218, with which flatness can be increased, it is possible to use an organic material such as polyamide, benzocyclobutene, acrylic, or epoxy, a siloxane material, or the like in addition to polyimide. In the case where an antenna is formed over the insulating film 1218, the flatness of the surface of the insulating film 1218 needs to be thus considered.

In addition, the insulating film 1218 preferably covers an end portion of the insulating film 1213 outside the antenna in a circuit portion (not illustrated). In the case where the insulating film 1218 covers the insulating film 1213, it is preferable to provide a margin of two or more times as large as the total thickness of the insulating film 1213 and the insulating film 1218 between the end of the insulating film 1213 and the end of the insulating film 1218. In this embodiment, since the insulating film 1213 is formed to a thickness of 1500 nm and the insulating film 1218 is formed to a thickness of 2000 nm, the end of the insulating film 1218, which covers the end portion of the insulating film 1213, is away from the end of the insulating film 1213 by a distance d=7000 nm. With such a structure, the process margin can be obtained and intrusion of water or oxygen can be prevented.

Figure 7:
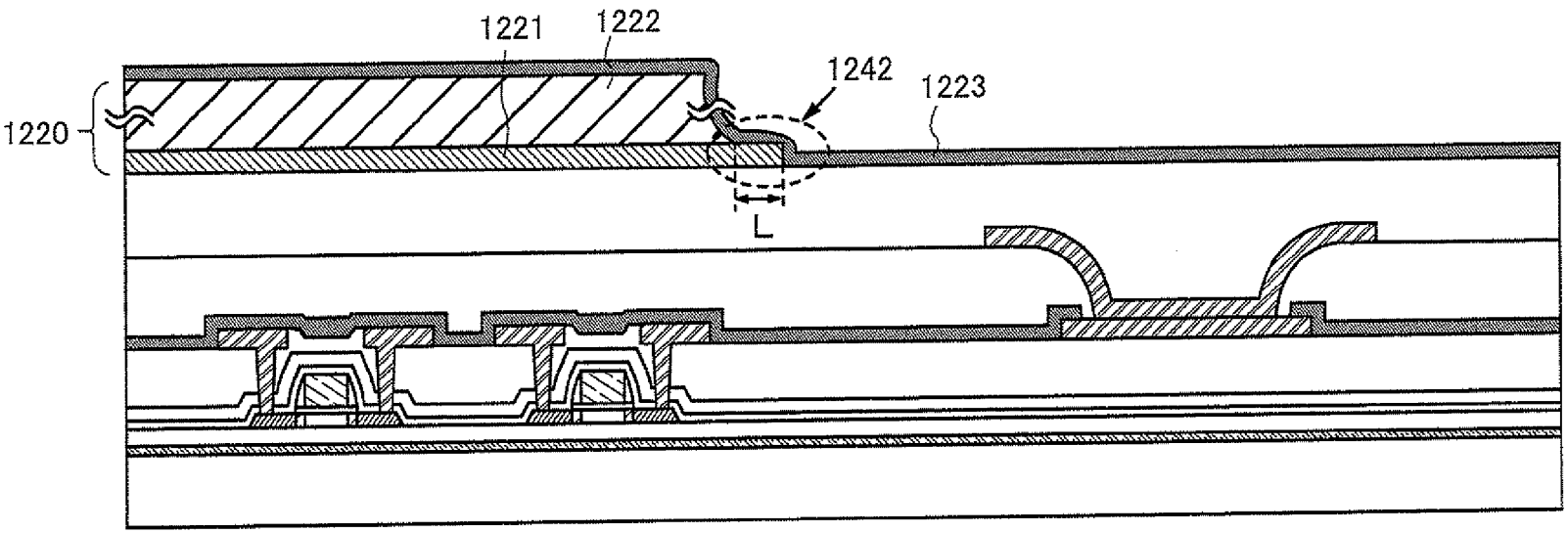
FIG. 7 is a diagram illustrating an example of a method for manufacturing a semiconductor integrated circuit.

Next, an antenna 1220 is formed over the insulating film 1218 (see FIG. 7). Then, the antenna 1220 and the conductive film 1217 are electrically connected to each other through an opening. The opening is formed below the antenna 1220 to be integrated. Note that the antenna 1220 may be directly connected to the conductive films 1231*a*; however, it is preferable to provide the conductive film 1217 as in this embodiment because the margin for forming the opening to be connected to the antenna 1220 can be obtained, resulting in high integration. Accordingly, another conductive film may be further provided over the conductive film 1217 to be connected to the antenna 1220. That is, the antenna 1220 may be electrically connected to the conductive films 1231*a* included in the thin film transistor and high integration can be realized by a connection structure in which a plurality of conductive films are interposed between the antenna 1220 and the conductive films 1231*a*. The thicknesses of the plurality of conductive films such as the conductive film 1217 are preferably small because large thicknesses thereof increase the thickness of the semiconductor integrated circuit itself. Thus, the conductive film 1217 and the like preferably have a small thickness as compared to the conductive films 1231*a*.

The antenna 1220 can have a multi-layer structure of a first conductive film 1221 and a second conductive film 1222. In this embodiment, a film of titanium with a thickness of 100 nm is used as the first conductive film 1221 and a film of aluminum with a thickness of 5000 nm is used as the second conductive film 1222, so that the antenna 1220 has a multi-layer structure. By employing a titanium film as the first conductive film 1221, the antenna can have increased moisture resistance and the adhesion between the insulating film 1218 and the antenna 1220 can also be increased. Furthermore, the use of titanium for the first conductive film 1221 can reduce the contact resistance between the first conductive film 1221 and the conductive film 1217. This is because, since the titanium film is formed as the uppermost layer of the conductive film 1217, the conductive film 1217 and the first conductive film 1221, both of which are made of titanium, are in contact with each other. The titanium film used as the first conductive film 1221 is formed by dry etching; thus, an end portion thereof often has a steep angle. Aluminum is a low resistance material, which is suitable for the antenna. In addition, the second conductive film 1222 is made thick to further reduce the resistance of the antenna. A decrease in the resistance of the antenna is preferable to increase the communication distance. The aluminum film used as the second conductive film 1222 is formed by wet etching; thus, an end portion thereof often has a tapered side surface. In this embodiment, the aluminum film is depressed towards inside in the tapered side surface. Further, when the second conductive film 1222 is wet-etched, the end portion of the second conductive film 1222 is inside the end portion of the first conductive film 1221 (a region 1242). For example, the end portion of the second conductive film 1222 may be provided inside the end portion of the first conductive film 1221 so that the distance therebetween is one-sixth to one-half the thickness of the second conductive film 1222 (a distance L). In this embodiment, the end portion of the second conductive film 1222 may be provided inside the end portion of the first conductive film 1221 by a distance L=0.8 μm to 2 μm. Since the end portion of the first conductive film 1221 projects from the end portion of the second conductive film 1222, disconnection of an insulating film formed later can be prevented and the durability of the antenna can be increased.

The antenna can be formed by CVD, sputtering, a printing method such as screen printing or gravure printing, droplet discharging, dispensing, plating, or the like. As a material for the antenna, it is possible to use, in addition to titanium and aluminum, a material containing a metal element such as silver, copper, gold, platinum, nickel, palladium, tantalum, or molybdenum, an alloy containing any of these metal elements, or a compound containing any of these metal elements. Although this embodiment shows an example in which the antenna has a multi-layer structure, the antenna may have a single-layer structure using any of the aforementioned materials.

An insulating film 1223 is formed to cover the antenna 1220. In this embodiment, a silicon nitride film with a thickness of 200 nm is formed as the insulating film 1223. It is preferable to provide the insulating film 1223 to further increase the moisture resistance of the antenna. Since the end portion of the titanium film projects from the end portion of the aluminum film, the insulating film 1223 can be formed thereover without disconnection. As such an insulating film 1223, a silicon oxynitride film, a Silicon nitride oxide film, or a film made of other inorganic materials can be used in addition to a silicon nitride film.

In such a manner, the semiconductor integrated circuit formed using the insulating substrate can be completed.

This embodiment can be implemented in appropriate combination with any of the other embodiments.

(Embodiment 5)

In this embodiment, an example a method for manufacturing an RFID tag with higher reliability and yield will be described with reference to FIGS. 9A to 9D. In this embodiment, a CMOS (complementary metal oxide semiconductor) will be described as an example of the semiconductor integrated circuit.

Figure 9A:
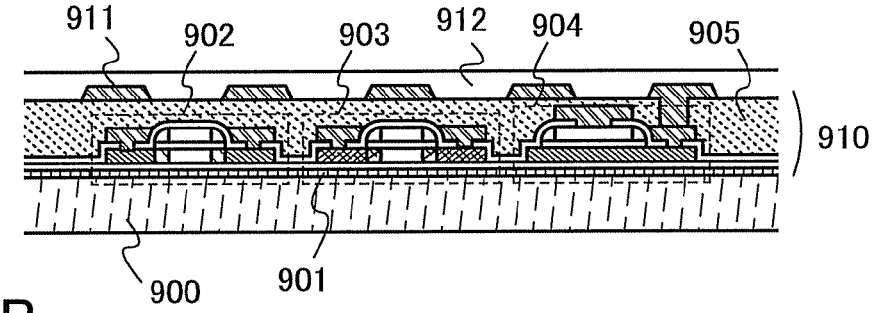
FIGS. 9A to 9D are diagrams illustrating an example of a method for manufacturing an RFID tag.
Figure 9B:
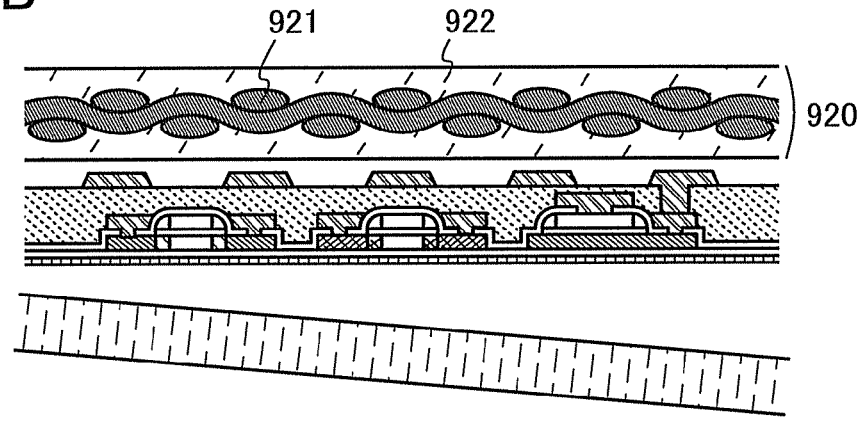

A transistor 902, a transistor 903, a capacitor 904, and an insulating layer 905 are provided over a substrate 900 with a separation layer 901 interposed therebetween, thereby forming a semiconductor integrated circuit 910 (see FIG. 9A).

The transistors 902 and 903 are thin film transistors, each of which includes a source and a drain region, a low-concentration impurity region, a channel formation region, a gate insulating layer, a gate electrode, and a source and a drain electrode. The source and drain regions are in contact with wirings serving as the source and drain electrodes, and are electrically connected thereto.

The transistor 902 is an n-channel transistor and includes an impurity element imparting n-type conductivity (such as phosphorus (P) or arsenic (As)) in the source and drain regions and the low-concentration impurity region. The transistor 903 is a p-channel transistor and includes an impurity element imparting p-type conductivity (such as boron (B), aluminum (Al), or gallium (Ga)) in the source and drain regions and the low-concentration impurity region.

The capacitor 904 is formed in a process similar to that of the transistors 902 and 903, and one electrode of the capacitor 904 is formed using a semiconductor film and the other electrode thereof is formed using a gate electrode. At this time, for efficiently ensuring a capacitance value, an impurity element may be added to the semiconductor film included in the capacitor 904 before the layer serving as the gate electrode layer is formed. In that process, an impurity element is also added to the semiconductor film arranged in a region under the layer serving as the gate electrode, and the capacitor can effectively operate.

Next, an antenna 911 formed of a conductive film is formed over the insulating layer 905 and a protective film 912 is formed over the antenna 911. The antenna 911 is electrically connected to the semiconductor integrated circuit. In FIG. 9A, the antenna 911 is electrically connected to one electrode of the capacitor 904.

Subsequently, an insulator 920 is formed over the protective film 912. As the insulator 920, for example, a structural body in which a fibrous body 921 is impregnated with an organic resin 922 may be used.

After the protective film 912 and the insulator 920 are bonded to each other, the semiconductor integrated circuit 910, the antenna 911, and the protective film 912 are separated from the substrate 900 with the separation layer 901 used as the interface. Thus, the semiconductor integrated circuit 910, the antenna 911, and the protective film 912 are provided on the insulator 920 side (see FIG. 9B).

The protective film 912 and the insulator 920 may be bonded to each other with an adhesive or by pressure bonding or heat pressure bonding.

Figure 9C:
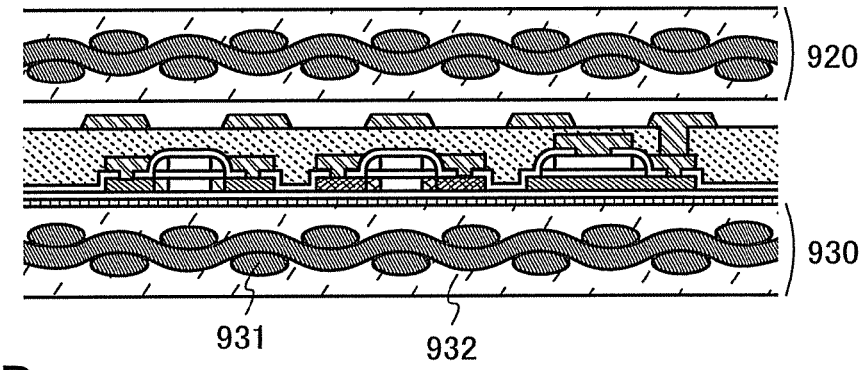

After that, an insulator 930 is bonded to an exposed separation surface of the semiconductor integrated circuit 910 with the separation layer 901 interposed therebetween, whereby the semiconductor integrated circuit 910, the antenna 911, and the protective film 912 are interposed between the insulator 920 and the insulator 930 (see FIG. 9C).

Like the insulator 920, a structural body in which a fibrous body 931 is impregnated with an organic resin 932 may be used as the insulator 930, for example.

A plurality of structural bodies in which a plurality of the semiconductor integrated circuits 910, the antennas 911, and the protective films 912 are formed are arranged in a plane direction and interposed between the insulator 920 and the insulator 930. When the plurality of structural bodies are divided into individual pieces, it is possible to manufacture semiconductor integrated circuit chips in each of which the semiconductor integrated circuit 910, the antenna 911, and the protective film 912 are interposed between the insulator 920 and the insulator 930. There is no particular limitation on a dividing means as long as the structural bodies can be divided physically. In this embodiment, as a preferable example, the division is performed by laser light irradiation along a dividing line.

Figure 9D:
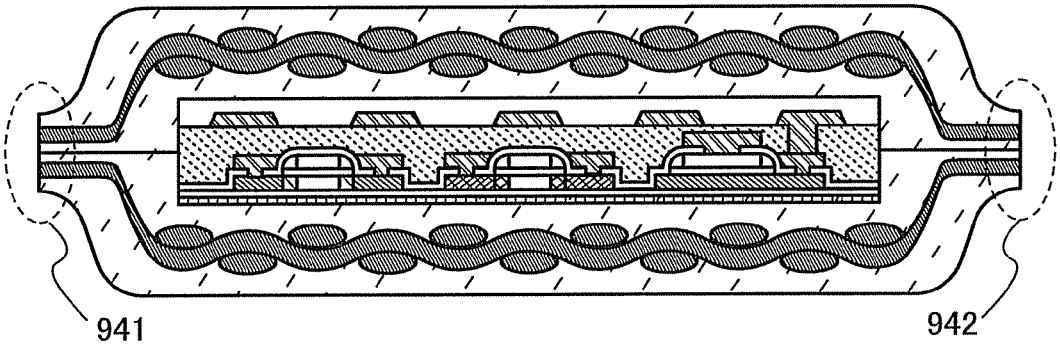
Figure 10A:
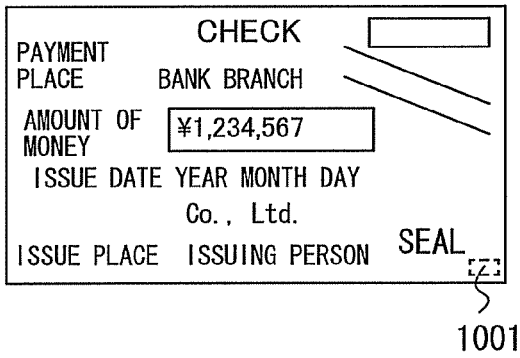
FIGS. 10A to 10G are views illustrating application examples of a semiconductor device.
Figure 10B:
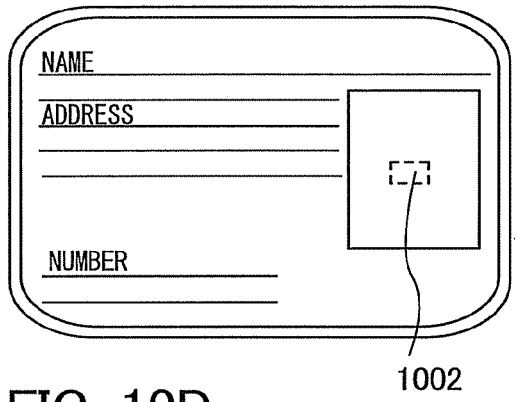
Figure 10C:
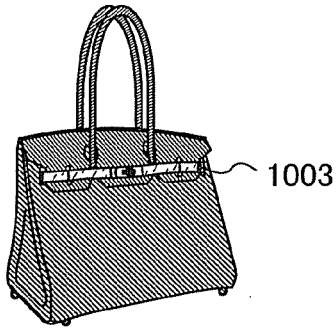
Figure 10D:
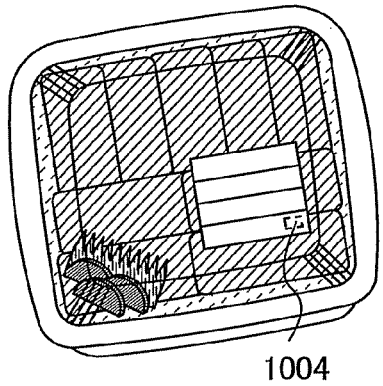
Figure 10E:
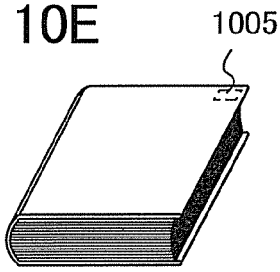
Figure 10F:
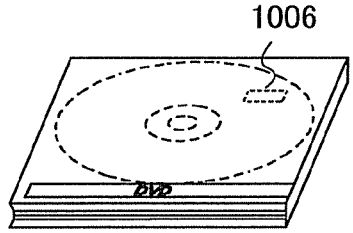
Figure 10G:
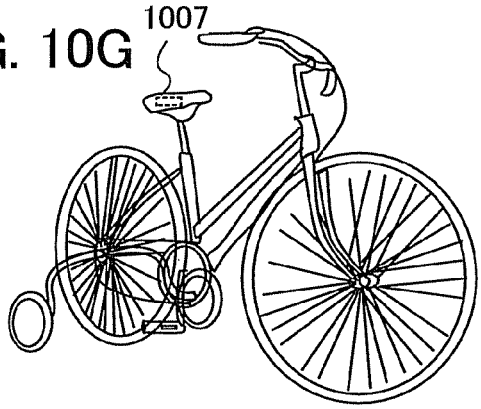

By the division with laser light irradiation, the insulators 920 and 930 melt and weld together on a divided surface 941 and a divided surface 942 of the semiconductor integrated circuit chips, whereby each semiconductor integrated circuit chip has a structure in which the semiconductor integrated circuit 910, the antenna 911, and the protective film 912 are entirely sealed with the insulators 920 and 930 (see FIG. 9D).

Here, another insulator may be further provided outside or inside the insulator 920 and the insulator 930 so that the semiconductor integrated circuit 910, the antenna 911, and the protective film 912 are covered more effectively.

Through the above process, the semiconductor integrated circuit is interposed between the insulators, which makes it possible to prevent adverse effects such as damage on or defective characteristics of the semiconductor integrated circuit due to external stress or internal stress. Accordingly, an RFID tag with high reliability can be manufactured with high yield.

Note that, by using a flexible insulator as the insulators 920 and 930 in the RFID tag manufactured in this embodiment, a flexible RFID tag can be obtained.

As a material for a semiconductor film included in the transistors 902 and 903 and the capacitor 904, it is possible to use an amorphous semiconductor (hereinafter, also referred to as an AS) that is formed by vapor-phase growth or sputtering using a semiconductor material gas typified by silane or germane, a polycrystalline semiconductor that is obtained by crystallizing the amorphous semiconductor by utilizing light energy or thermal energy, a microcrystalline semiconductor (also referred to as a semi-amorphous or microcrystal semiconductor, and hereinafter, also referred to as an SAS), or the like. The semiconductor film can be deposited by sputtering, LPCVD, plasma CVD, or the like.

Considering Gibbs free energy, the microcrystalline semiconductor film is in a metastable state that is intermediate between an amorphous state and a single crystal state. That is, the microcrystalline semiconductor is in a third state that is stable in free energy, and has short-range order and lattice distortion. Columnar or needle-like crystals grow in the direction of the normal to the surface of the substrate. The Raman spectrum of microcrystalline silicon, which is a typical example of a microcrystalline semiconductor, is shifted to a lower wavenumber side than 520 $cm^{-1}$ that represents single crystal silicon. In other words, the Raman spectrum of microcrystalline silicon has a peak between 480 $cm^{-1}$ that represents amorphous silicon and 520 $cm^{-1}$ that represents single crystal silicon. Furthermore, the microcrystalline semiconductor film contains 1 atomic % or more of hydrogen or halogen to terminate dangling bonds. The microcrystalline semiconductor film may further contain a rare gas element such as helium, argon, krypton, or neon to further promote lattice distortion, whereby a favorable microcrystalline semiconductor film with improved stability can be obtained.

This microcrystalline semiconductor film can be formed by a high-frequency plasma CVD method with a frequency of several tens of megahertz to several hundreds of megahertz, or a microwave plasma CVD method with a frequency of 1 GHz or more. Typically, the microcrystalline semiconductor film can be formed using silicon hydride, such as $SiH_4$, $Si_2H_6$, $SiH_2Cl_2$, $SiHCl_3$, $SiCl_4$, or $SiF_4$, that is diluted with hydrogen. Furthermore, the microcrystalline semiconductor film can be formed with a dilution of silicon hydride, hydrogen, and one or more kinds of rare gas elements selected from helium, argon, krypton, and neon. In such a case, the flow rate ratio of hydrogen to silicon hydride is set to 5:1 to 200:1, preferably, 50:1 to 150:1, and more preferably, 100:1.

The amorphous semiconductor is typified by hydrogenated amorphous silicon, and the crystalline semiconductor is typified by polysilicon (polycrystalline silicon) or the like. Polysilicon includes so-called high-temperature polysilicon that contains polysilicon formed at a process temperature of 800° C. or higher as its main component, so-called low-temperature polysilicon that contains polysilicon formed at a process temperature of 600° C. or lower as its main component, and polysilicon formed by crystallizing amorphous silicon by using, for example, an element that promotes crystallization. It is needless to say that a microcrystalline semiconductor or a semiconductor partially including a crystalline phase can also be used as described above.

As a material for the semiconductor, a compound semiconductor such as GaAs, InP, SiC, ZnSe, GaN, or SiGe as well as an element such as silicon (Si) or germanium (Ge) can be used. It is also possible to use an oxide semiconductor such as zinc oxide (ZnO), tin oxide ($SnO_2$), magnesium zinc oxide, gallium oxide, or indium oxide, an oxide semiconductor including two or more of the above oxide semiconductors, or the like. For example, an oxide semiconductor formed of zinc oxide, indium oxide, and gallium oxide may be used. In the case of using zinc oxide for the semiconductor film, a gate insulating layer is preferably formed of $Y_2O_3$, $Al_2O_3$, $TiO_2$, a stack thereof, or the like, and a layer serving as a gate electrode and wirings serving as a source and a drain electrode layer are preferably formed of ITO, Au, Ti, or the like. In addition, In, Ga, or the like may be added to ZnO.

In the case of using a crystalline semiconductor film for the semiconductor film, the crystalline semiconductor film may be manufactured by various methods (e.g., laser crystallization, thermal crystallization, or thermal crystallization using an element such as nickel that promotes crystallization). Alternatively, a microcrystalline semiconductor, which is an SAS, may be crystallized by laser irradiation to increase crystallinity. In the case where an element that promotes crystallization is not introduced, before being irradiated with laser light, an amorphous silicon film is heated at 500° C. for one hour under a nitrogen atmosphere, whereby hydrogen contained in the amorphous silicon film is released to a concentration of $1\times10^{20}$ atoms/cm$^3$ or less. This is because, if the amorphous silicon film contains much hydrogen, the amorphous semiconductor film is broken by laser irradiation.

There is no particular limitation on a method for introducing a metal element into the amorphous semiconductor film as long as the metal element can exist on the surface of or inside the amorphous semiconductor film. For example, sputtering, CVD, plasma processing (including plasma CVD), an adsorption method, or a method of applying a metal salt solution can be employed. Among them, the method using a solution is simple and easy, and is useful in terms of easy concentration adjustment of the metal element. At this time, an oxide film is preferably deposited by UV light irradiation in an oxygen atmosphere, thermal oxidation, treatment with ozone water or hydrogen peroxide including a hydroxyl radical, or the like in order to improve the wettability of the surface of the amorphous semiconductor film and to spread an aqueous solution on the entire surface of the amorphous semiconductor film.

In a crystallization step for crystallizing the amorphous semiconductor film to form a crystalline semiconductor film, an element that promotes crystallization (also referred to as a catalytic element or a metal element) may be added to the amorphous semiconductor film, and crystallization may be performed by heat treatment (at 550° C. to 750° C. for 3 minutes to 24 hours). As the element that promotes crystallization, it is possible to use one or more kinds of elements selected from iron (Fe), nickel (Ni), cobalt (Co), ruthenium (Ru), rhodium (Rh), palladium (Pd), osmium (Os), iridium (Ir), platinum (Pt), copper (Cu), and gold (Au).

In order to remove or reduce the element that promotes crystallization from the crystalline semiconductor film, a semiconductor film containing an impurity element is formed in contact with the crystalline semiconductor film so as to function as a gettering sink. As the impurity element, an impurity element imparting n-type conductivity, an impurity element imparting p-type conductivity, a rare gas element, or the like can be used. For example, it is possible to use one or more kinds of elements selected from phosphorus (P), nitrogen (N), arsenic (As), antimony (Sb), bismuth (Bi), boron (B), helium (He), neon (Ne), argon (Ar), krypton (Kr), and xenon (Xe). A semiconductor film containing a rare gas element is formed in contact with the crystalline semiconductor film containing the element that promotes crystallization, and then heat treatment is performed (at 550° C. to 750° C. for 3 minutes to 24 hours). The element promoting crystallization that is contained in the crystalline semiconductor film moves into the semiconductor film containing a rare gas element, and thus the element promoting crystallization that is contained in the crystalline semiconductor film is removed or reduced. After that, the semiconductor film containing a rare gas element, which has functioned as a gettering sink, is removed.

The amorphous semiconductor film may be crystallized by a combination of thermal treatment and laser light irradiation. Alternatively, either thermal treatment or laser light irradiation may be performed plural times.

A crystalline semiconductor film can also be formed directly over the substrate by a plasma method. Alternatively, a crystalline semiconductor film may be selectively formed over the substrate by a plasma method.

The gate insulating layer may be formed of silicon oxide or a stack of silicon oxide and silicon nitride. The gate insulating layer may be formed by depositing an insulating film by plasma CVD or reduced pressure CVD, or may be formed by solid-phase oxidation or solid-phase nitridation by plasma treatment. This is because a gate insulating layer formed by oxidizing or nitriding a single crystal semiconductor film by plasma treatment is dense and has high withstand voltage and high reliability. For example, the surface of the semiconductor film is oxidized or nitrided using nitrous oxide ($N_2O$) diluted with Ar by 1 to 3 times (flow rate ratio), at a microwave (2.45 GHz) power of 3 kW to 5 kW and a pressure of 10 Pa to 30 Pa. An insulating film with a thickness of 1 nm to 10 nm (preferably, 2 nm to 6 nm) is formed by this treatment. Furthermore, nitrous oxide ($N_2O$) and silane ($SiH_4$) are introduced and a microwave (2.45 GHz) power of 3 kW to 5 kW is applied at a pressure of 10 Pa to 30 Pa, whereby a silicon oxynitride film is formed by vapor-phase growth to form the gate insulating layer. By combining the solid-phase reaction and the vapor-phase growth, a gate insulating layer having a low interface state density and a high withstand voltage can be obtained.

The gate insulating layer may also be formed of a high dielectric constant material such zirconium dioxide, hafnium oxide, titanium dioxide, or tantalum pentoxide. By using the high dielectric constant material for the gate insulating layer, the gate leakage current can be reduced.

The layer serving as a gate electrode can be formed by CVD, sputtering, droplet discharging, or the like. The layer serving as a gate electrode may be formed of an element selected from Ag, Au, Cu, Ni, Pt, Pd, Ir, Rh, W, Al, Ta, Mo, Cd, Zn, Fe, Ti, Si, Ge, Zr, and Ba, or an alloy or a compound containing any of the elements as its main component. Alternatively, a semiconductor film typified by a polycrystalline silicon film doped with an impurity element such as phosphorus, or AgPdCu alloy may be used. The layer serving as a gate electrode may have a single-layer structure or a multi-layer structure, and for example, may have a two-layer structure of a tungsten nitride film and a molybdenum film, or a three-layer structure in which a film of tungsten with a thickness of 50 nm, a film of aluminum-silicon alloy (Al—Si) with a thickness of 500 nm, and a film of titanium nitride with a thickness of 30 nm are sequentially stacked. In the case where a three-layer structure is employed, a film of tungsten nitride may be used instead of the tungsten film as the first conductive film, a film of aluminum-titanium alloy may be used instead of the aluminum-silicon alloy (Al—Si) film as the second conductive film, or a film of titanium may be used instead of the titanium nitride film as the third conductive film.

The layer serving as a gate electrode may also be formed of a light-transmitting material that transmits visible light. As the light-transmitting conductive material, indium tin oxide (ITO), indium tin oxide containing silicon oxide (ITSO), organic indium, organotin, zinc oxide, or the like can be used. Alternatively, indium zinc oxide (IZO) containing zinc oxide (ZnO), zinc oxide (ZnO), ZnO doped with gallium (Ga), tin oxide ($SnO_2$), indium oxide containing tungsten oxide, indium zinc oxide containing tungsten oxide, indium oxide containing titanium oxide, indium tin oxide containing titanium oxide, or the like may be used.

In the case where etching processing is needed for forming the layer serving as a gate electrode, dry etching or wet etching may be performed using a mask. The electrode layer can be etched into a tapered shape by ICP (inductively coupled plasma) etching while appropriately controlling the etching conditions (e.g., the amount of electric power applied to a coiled electrode, the amount of electric power applied to an electrode on the substrate side, and the electrode temperature on the substrate side). Note that as an etching gas, a chlorine-based gas typified by $Cl_2$, $BCl_3$, $SiCl_4$, $CCl_4$, or the like; a fluorine-based gas typified by $CF_4$, $SF_6$, $NF_3$, or the like; or $O_2$ can be used as appropriate.

Although a single-gate transistor is described in this embodiment, a multi-gate transistor such as a double-gate transistor may also be used. In that case, a layer serving as a gate electrode may be provided above and below a semiconductor film, or a plurality of layers serving as gate electrodes may be provided only on one side of (above or below) the semiconductor film.

Further, a transistor may employ a structure in which a silicide is provided for the source and drain regions. The silicide is formed in such a manner that a conductive film is formed over the source and drain regions of the semiconductor film, and silicon in exposed source and drain regions of the semiconductor film is made to react with the conductive film by heat treatment, a GRTA method, an LRTA method, or the like. The silicide may be formed by laser irradiation or light irradiation with a lamp. As a material for the conductive film for forming the silicide, is it possible to use titanium (Ti), nickel (Ni), tungsten (W), molybdenum (Mo), cobalt (Co), zirconium (Zr), hafnium (Hf), tantalum (Ta), vanadium (V), neodymium (Nd), chromium (Cr), platinum (Pt), palladium (Pd), or the like.

The wiring layers serving as a source and a drain electrode layer can be formed in such a manner that a conductive film is formed by PVD, CVD, evaporation, or the like and then is etched into a desired shape. Alternatively, the wiring layers can be selectively formed in a predetermined place by printing, electroplating, or the like. Further, a reflow method or a damascene method may also be used. The wiring layers may be formed of a metal such as Ag, Au, Cu, Ni, Pt, Pd, Ir, Rh, W, Al, Ta, Mo, Cd, Zn, Fe, Ti, Zr, or Ba, a semiconductor such as Si or Ge, or an alloy or a nitride thereof. Further, a light-transmitting material can also be used.

As the light-transmitting conductive material, it is possible to use indium tin oxide (ITO), indium tin oxide containing silicon oxide (ITSO), indium zinc oxide (IZO) containing zinc oxide (ZnO), zinc oxide (ZnO), ZnO doped with gallium (Ga), tin oxide ($SnO_2$), indium oxide containing tungsten oxide, indium zinc oxide containing tungsten oxide, indium oxide containing titanium oxide, indium tin oxide containing titanium oxide, or the like.

(Embodiment 6)

A semiconductor device such as a wireless tag includes a semiconductor integrated circuit that is provided with a plurality of minute semiconductor elements. Therefore, malfunction of the circuit or damage on the semiconductor elements is likely to occur due to electrostatic discharge (ESD) applied from the outside. In particular, electrostatic discharge is most likely to occur in an antenna and the like having a conductor with a large surface area, as in a wireless tag and the like. This embodiment shows an example of a structure of a semiconductor integrated circuit which is protected against such electrostatic discharge.

FIGS. 8A to 8D illustrate examples of a structure of an RFID tag. In this embodiment, a shield containing a conductive material is provided near a semiconductor integrated circuit, thereby protecting the semiconductor integrated circuit.

Figure 8A:
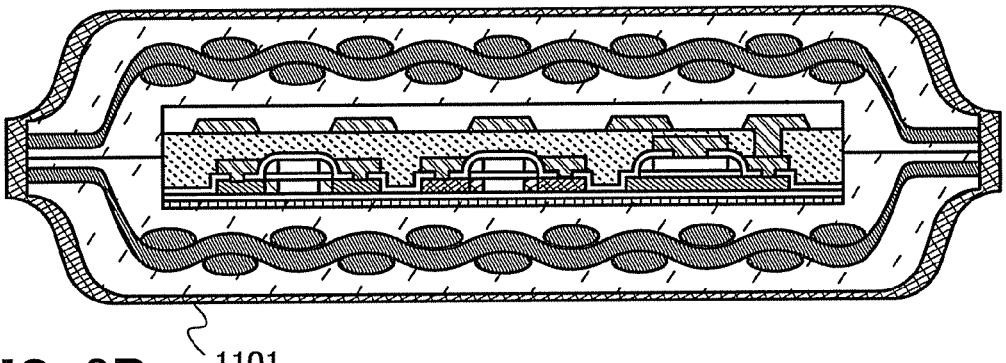
FIGS. 8A to 8D are diagrams each illustrating an example of a structure of an RFID tag.

FIG. 8A illustrates an example in which a shield 1101 is provided to cover the entire outside of a semiconductor integrated circuit chip. The shield 1101 may be formed to a thickness that prevents, as much as possible, blocking of the reception of a carrier wave or an amplitude modified wave transmitted from a reader/writer by an antenna.

In FIG. 8A, the shield 1101 is formed to cover the top surface, bottom surface, and side surfaces of the semiconductor integrated circuit chip. The shield 1101 may be formed in the following manner: after the shield is formed on the top surface and a part of the side surfaces, the semiconductor integrated circuit is turned over and the shield is formed on the bottom surface and the other part of the side surfaces, thereby covering the entire surface of the semiconductor integrated circuit.

Figure 8B:
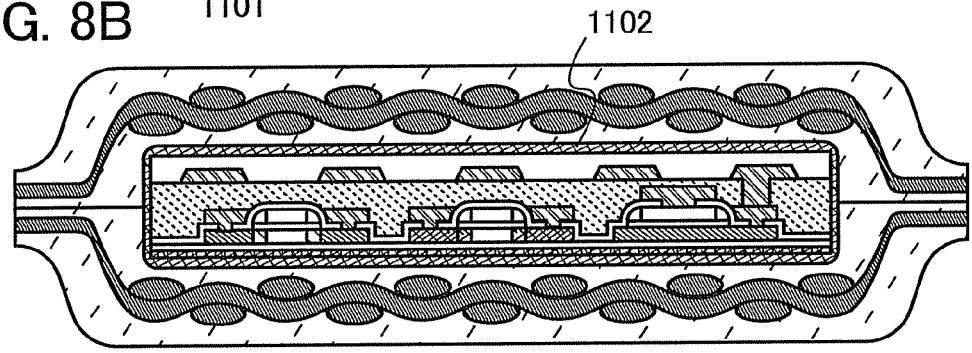

FIG. 8B illustrates an example in which a shield 1102 is provided inside an insulator to cover the entire surface of a semiconductor integrated circuit. In order to form the shield 1102 so that it covers the entire surface of the semiconductor integrated circuit, the semiconductor integrated circuit needs to be divided into each semiconductor integrated circuit chip and then covered with the shield 1102 before being interposed and sealed between insulators. However, one embodiment of the present invention is not particularly limited to this method. For example, the shield may be formed on the top surface and bottom surface of the semiconductor integrated circuit before the semiconductor integrated circuit chip is interposed and sealed between insulators, and then the semiconductor integrated circuit may be divided by laser light irradiation, so that the shield can be melted on divided surfaces to cover the side surfaces of the semiconductor integrated circuit chip.

Figure 8C:
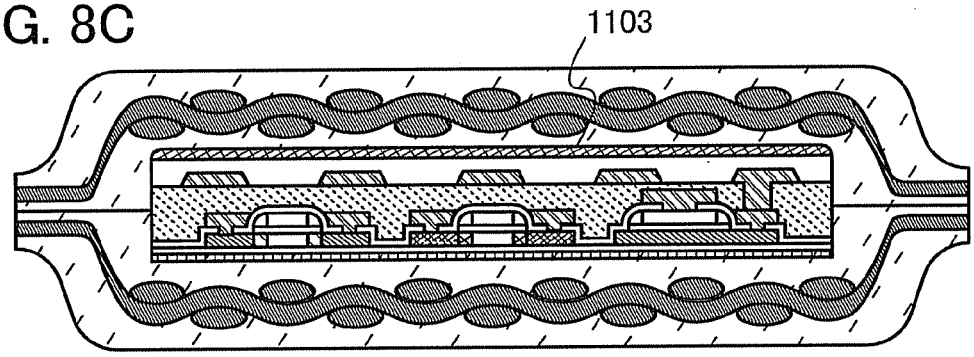

FIG. 8C illustrates an example in which a shield 1103 is provided inside an insulator and only on one surface of a semiconductor integrated circuit. In this example, the shield 1103 is formed on the antenna side; however, the shield 1103 may be formed on the separation surface side.

When the shield is formed only on one surface of the semiconductor integrated circuit, a carrier wave or an amplitude modulated wave transmitted from a reader/writer can be received by the antenna without being blocked by the shield. Thus, communication can be performed with high accuracy.

Figure 8D:
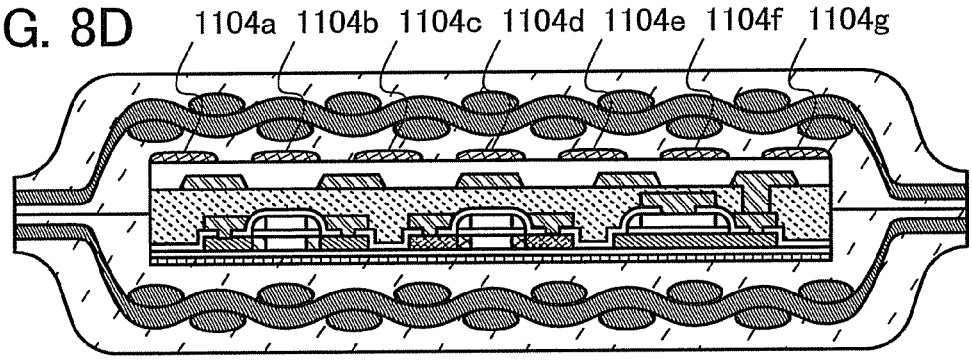

Although FIGS. 8A to 8C illustrate an example in which the shield is formed using a film made of a conductive material, island-like shields 1104*a* to 1104*g* may be formed as illustrated in FIG. 8D. Each of the shields 1104*a* to 1104*g* is made of a conductive material and has conductivity; however, the shields 1104*a* to 1104*g* are separately formed and thus are not electrically connected to each other. For example, the shields 1104*a* and 1104*b*, or the shields 1104*c* and 1104*g* are not electrically connected to each other. By employing such a structure, although each of the shields 1104*a* to 1104*g* is made of a conductive material, the shields 1104*a* to 1104*g* as a whole can be regarded as a film equivalent to an insulator. Such a structure of the shields can protect a semiconductor integrated circuit against electrostatic discharge, because each of the shields 1104*a* to 1104*g* is made of a conductive material. At the same time, since the shields 1104*a* to 1104*g* as a whole are not a conductive film, a carrier wave or an amplitude modulated wave transmitted from a reader/writer can be received by an antenna without being blocked by the shields. Thus, communication can be performed with high accuracy.

The shields illustrated in FIGS. 8A to 8D are preferably made of a conductor or a semiconductor, and for example, a metal film, a metal oxide film, a semiconductor film, or a metal nitride film can be used. Specifically, the shields can be made of an element selected from titanium, molybdenum, tungsten, aluminum, copper, silver, gold, nickel, platinum, palladium, iridium, rhodium, tantalum, cadmium, zinc, iron, silicon, germanium, zirconium, or barium; or an alloy material, a compound material, a nitride material, an oxide material, or the like, which contains any of the above elements as a main component.

As the nitride material, tantalum nitride, titanium nitride, or the like can be used.

As the oxide material, indium tin oxide (ITO), indium tin oxide containing silicon oxide (ITSO), organoindium, organotin, zinc oxide, or the like can be used. Alternatively, indium zinc oxide (IZO) containing zinc oxide (ZnO), zinc oxide (ZnO), zinc oxide containing gallium (Ga), tin oxide ($SnO_2$), indium oxide containing tungsten oxide, indium zinc oxide containing tungsten oxide, indium oxide containing titanium oxide, indium tin oxide containing titanium oxide, or the like may be used.

Alternatively, the shields can be formed using a semiconductor film or the like having conductivity, which is obtained by adding an impurity element or the like to a semiconductor. For example, a polycrystalline silicon film doped with an impurity element such as phosphorus can be used.

Furthermore, as a material for the shields, a conductive macromolecule (also referred to as a conductive polymer) may be used. As the conductive macromolecule, a so-called π-electron conjugated conductive polymer can be used. For example, it is possible to use polyaniline and/or a derivative thereof, polypyrrole and/or a derivative thereof, polythiophene and/or a derivative thereof, and a copolymer of two or more kinds of those materials.

Specific examples of a conjugated conductive polymer are given below: polypyrrole, poly(3-methylpyrrole), poly(3-butylpyrrole), poly(3-octylpyrrole), poly(3-decylpyrrole), poly(3,4-dimethylpyrrole), poly(3,4-dibutylpyrrole), poly(3-hydroxypyrrole), poly(3-methyl-4-hydroxypyrrole), poly(3-methoxypyrrole), poly(3-ethoxypyrrole), poly(3-octoxypyrrole), poly(3-carboxylpyrrole), poly(3-methyl-4-carboxylpyrrole), polyN-methylpyrrole, polythiophene, poly(3-methylthiophene), poly(3-butylthiophene), poly(3-octylthiophene), poly(3-decylthiophene), poly(3-dodecylthiophene), poly(3-methoxythiophene), poly(3-ethoxythiophene), poly(3-octoxythiophene), poly(3-carboxylthiophene), poly(3-methyl-4-carboxylthiophene), poly(3,4-ethylenedioxythiophene), polyaniline, poly(2-methylaniline), poly(2-octylaniline), poly(2-isobutylaniline), poly(3-isobutylaniline), poly(2-anilinesulfonic acid), and poly(3-anilinesulfonic acid).

An organic resin or a dopant (a halogen, a Lewis acid, an inorganic acid, an organic acid, a transition metal halide, an organic cyano compound, a nonionic surfactant, or the like) may be contained in the shields containing a conductive macromolecule.

The shields can be formed by a dry process such as sputtering, plasma CVD, or evaporation, or a wet process such as coating, printing, or droplet discharging (ink-jet).

(Embodiment 7)

By using the aforementioned embodiments, a semiconductor device functioning as a wireless tag (hereinafter, also referred to as a wireless chip, a wireless processor, or a wireless memory) can be manufactured. The application range of the semiconductor device using the above embodiments is so wide and can be applied to any product in order that the information on the product such as the history thereof is recognized in a non-contact manner and utilized in production, management, and the like. For example, the semiconductor device can be incorporated in bills, coins, securities, certificates, bearer bonds, packaging containers, books, recording media, personal belongings, vehicles, groceries, garments, health products, household goods, medicines, and electronic devices. Application examples of the semiconductor device will be described with reference to FIGS. 10A to 10G.

Bills and coins are money that circulates in the market, and include ones that can be used in the same way as money in a specific area (cash vouchers), commemorative coins, and the like. The securities refer to checks, certificates, promissory notes, and the like, and can be provided with an RFD) tag 1001 using a regulator circuit (see FIG. 10A). The certificates refer to driver's licenses, certificates of residence, and the like, and can be provided with an RFID tag 1002 using a regulator circuit (see FIG. 10B). The personal belongings refer to bags, a pair of glasses, and the like, and can be provided with an RFID tag 1003 using a regulator circuit (see FIG. 10C). Bearer bonds refer to stamps, rice coupons, various merchandise coupons, and the like. The packaging containers refer to wrapping paper for a lunch box or the like, plastic bottles, and the like, and can be provided with an RFID tag 1004 using a regulator circuit (see FIG. 10D). The books refer to hardbacks, paperbacks, and the like, and can be provided with an RFID tag 1005 using a regulator circuit (see FIG. 10E). The recording media refer to DVD software, video tapes, and the like, and can be provided with an RFID tag 1006 using a regulator circuit (see FIG. 10F). The vehicles refer to wheeled vehicles such as bicycles, ships, and the like, and can be provided with an RFID tag 1007 using a regulator circuit (see FIG. 10G). The groceries refer to foods, beverages, and the like. The garments refer to clothes, shoes, and the like. The health products refer to medical apparatuses, health appliances, and the like. The household goods refer to furniture, lighting apparatuses, and the like. The medicines refer to drugs, agricultural chemicals, and the like. The electronic devices refer to liquid crystal display devices, EL display devices, television sets (television receivers, thin television receivers), cellular phones, and the like. Such products may be provided with the semiconductor device disclosed in this specification.

Such a semiconductor device can be provided by being attached to the surface of a product or being embedded in a product. For example, in the case of a book, the semiconductor device may be embedded in the paper; and in the case of a package made of an organic resin, the semiconductor device may be embedded in the organic resin.

By thus providing a semiconductor device in the packaging containers, the recording media, the personal belongings, the groceries, the garments, the household goods, the electronic devices, and the like, the efficiency of an inspection system, a system used in a rental shop, or the like can be improved. In addition, by providing a semiconductor device in the vehicles, forgery or theft can be prevented. Moreover, when a semiconductor device is implanted into creatures such as animals, each creature can be identified easily. For example, by implanting or attaching a semiconductor device with a sensor in or to a creature such as livestock, its health condition such as a current body temperature as well as its year of birth, sex, breed, or the like can be easily managed.

Note that this embodiment can be implemented in appropriate combination with any of the other embodiments and example disclosed in this specification.

EXAMPLE 1

Figure 4:
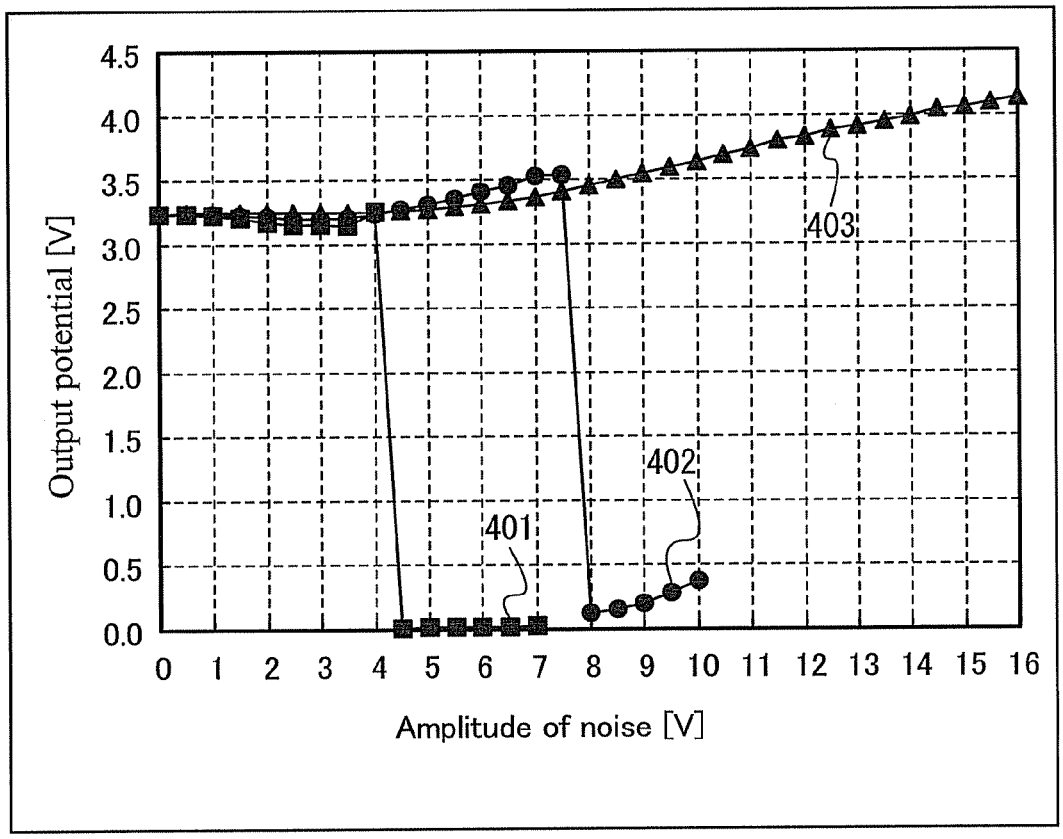
FIG. 4 is a graph showing a circuit simulation result.

FIG. 4 is the circuit simulation result showing how noise margin varies depending on the presence of a bypass capacitor in a regulator circuit having the configuration shown in Embodiment 3.

The simulation was performed in the following conditions: a signal corresponding to a 13.56 MHz carrier wave that is transmitted and received to and from an RFID tag was assumed to be noise and the signal was input to all of the nodes in the circuit illustrated in FIG. 3 via capacitive coupling corresponding to the parasitic capacitance between each of the nodes and a shield provided outside. The noise intensity was represented by changing the amplitude of an input carrier wave, and a change in the output potential of an output signal line of the regulator circuit was calculated while the amplitude was changed from 0 V to 16 V.

In FIG. 4, the horizontal axis represents the amplitude of noise corresponding to a 13.56 MHz carrier wave, which is applied to each of the nodes, and the vertical axis represents the output potential of the output signal line. The $V_{pp}$ of noise (peak to peak voltage: a voltage between the maximum voltage and minimum voltage of the noise waveform) is twice as high as the aforementioned amplitude.

Note that, when the parasitic capacitance was extracted from an actual chip layout, the parasitic capacitance between each of the nodes where the bypass capacitors are provided (the nodes to which the gates of the transistors 101 to 104 are connected) and the shield was as follows: the parasitic capacitance between the shield and the node to which the gates of the transistors 101 and 102 are connected was about 30 fF; between the shield and the node to which the gate of the transistor 104 is connected, about 35 fF; and between the shield and the node to which the gate of the transistor 103 is connected, about 50 fF.

In FIG. 4, reference numeral 401 (square points) indicates the output potential of the output signal line of the regulator circuit that does not include a bypass capacitor. Reference numeral 402 (circular points) indicates the output potential of the output signal line of the regulator circuit that includes a bypass capacitor of 1 pF for the node to which the gate of the transistor 104 is connected. Reference numeral 403 (triangular points) indicates the output potential of the output signal line of the regulator circuit that includes a bypass capacitor of 3 pF, a bypass capacitor of 3 pF, and a bypass capacitor of 2 pF for the node to which the gate of the transistor 104 is connected, the node to which the gates of the transistors 101 and 102 are connected, and the node to which the gate of the transistor 103 is connected, respectively.

In the case where no bypass capacitor is provided (401), the output potential of the output signal line drops to about 0 V when the amplitude of superimposed noise becomes about 4 V. This shows that a normal output potential cannot be maintained in the regulator circuit because of the superimposed noise.

On the other hand, in the case where the bypass capacitor of 1 pF is provided for the node to which the gate of the transistor 104 is connected (402), the output potential of the output signal line is normally kept almost constant until the amplitude of superimposed noise becomes about 7.5 V. This shows that the noise margin is increased.

Furthermore, in the case where the bypass capacitor of 3 pF, the bypass capacitor of 3 pF, and the bypass capacitor of 2 pF are provided for the node to which the gate of the transistor 104 is connected, the node to which the gates of the transistors 101 and 102 are connected, and the node to which the gate of the transistor 103 is connected, respectively (403), the output potential of the output signal line can be kept almost constant regardless of the amplitude of superimposed noise.

As described above, by providing the bypass capacitor for the node to which the gate of the transistor included in the bias circuit is connected, a change in the output potential can be prevented, resulting in a significant improvement in the noise margin of the regulator circuit.

Note that it is apparent to those skilled in the art that modes and details of the aforementioned embodiments and example can be modified in a wide variety of ways without departing from the spirit and scope of the disclosed invention. Accordingly, the disclosed invention should not be construed as being limited to the description of the embodiments and example.

This application is based on Japanese Patent Application serial No. 2009-007207 filed with Japan Patent Office on Jan. 16, 2009, the entire contents of which are hereby incorporated by reference.

The invention claimed is:

1. A regulator circuit comprising:

a first terminal supplied with a first potential;

a second terminal having a second potential, wherein the first potential is different from the second potential;

a bias circuit including a first transistor, a second transistor, a third transistor, a fourth transistor, a resistor, and a bypass capacitor; and a voltage regulator electrically connected to the first terminal, the second terminal, and the bias circuit, wherein a gate of the first transistor is electrically connected to a gate of the second transistor, one of a source and a drain of the first transistor is electrically connected to the second terminal, and the other of the source and the drain of the first transistor is electrically connected to one of a source and a drain of the third transistor, wherein the gate of the second transistor is electrically connected to one of a source and a drain of the second transistor, and one of a source and a drain of the fourth transistor, and the other of the source and the drain of the second transistor is electrically connected to the second terminal, wherein a gate of the third transistor is electrically connected to the other of the source and the drain of the fourth transistor, and the other of the source and the drain of the third transistor is electrically connected to the first terminal, wherein a gate of the fourth transistor is electrically connected to the one of the source and the drain of the third transistor, wherein one terminal of the resistor is electrically connected to the gate of the third transistor, and the other terminal of the resistor is electrically connected to the first terminal, and wherein the bypass capacitor is provided between a node connected to the gate of the fourth transistor and one of the first terminal and the second terminal.

2. The regulator circuit according to claim 1, wherein the bypass capacitor is configured to prevent a change in a potential of the gate connected to the node where the bypass capacitor is provided.

3. The regulator circuit according to claim 1, wherein the bias circuit is configured to generate a reference potential on the basis of a potential difference between the first terminal and the second terminal, and wherein the voltage regulator is configured to output a potential to an output terminal on the basis of the reference potential generated by the regulator circuit.

4. The regulator circuit according to claim 1, wherein one of the third transistor and the fourth transistor is a single-gate transistor.

5. The regulator circuit according to claim 1, wherein one of the third transistor and the fourth transistor is a double-gate transistor.

6. The regulator circuit according to claim 1, wherein the voltage regulator includes a differential amplifier circuit and a feedback circuit.

7. The regulator circuit according to claim 1, wherein the first terminal is not grounded.

8. A wireless tag comprising the regulator circuit according to claim 1.

9. A regulator circuit comprising:

a first terminal supplied with a first potential;

a second terminal having a second potential, wherein the first potential is different from the second potential;

a bias circuit including a first transistor, a second transistor, a third transistor, a fourth transistor, a resistor, and a bypass capacitor; and a voltage regulator electrically connected to the first terminal, the second terminal, and the bias circuit, wherein a gate of the first transistor is electrically connected to a gate of the second transistor, one of a source and a drain of the first transistor is electrically connected to the second terminal, and the other of the source and the drain of the first transistor is electrically connected to one of a source and a drain of the third transistor, wherein the gate of the second transistor is electrically connected to one of a source and a drain of the second transistor, and one of a source and a drain of the fourth transistor, and the other of the source and the drain of the second transistor is electrically connected to the second terminal, wherein a gate of the third transistor is electrically connected to the other of the source and the drain of the fourth transistor, and the other of the source and the drain of the third transistor is electrically connected to the first terminal, wherein a gate of the fourth transistor is electrically connected to the one of the source and the drain of the third transistor, wherein one terminal of the resistor is electrically connected to the gate of the third transistor, and the other terminal of the resistor is electrically connected to the first terminal, and wherein the bypass capacitor is provided between a node connected to the gate of the first transistor and one of the first terminal and the second terminal.

10. The regulator circuit according to claim 9, wherein the bypass capacitor is configured to prevent a change in a potential of the gate connected to the node where the bypass capacitor is provided.

11. The regulator circuit according to claim 9, wherein the bias circuit is configured to generate a reference potential on the basis of a potential difference between the first terminal and the second terminal, and wherein the voltage regulator is configured to output a potential to an output terminal on the basis of the reference potential generated by the regulator circuit.

12. The regulator circuit according to claim 9, wherein one of the third transistor and the fourth transistor is a single-gate transistor.

13. The regulator circuit according to claim 9, wherein one of the third transistor and the fourth transistor is a double-gate transistor.

14. The regulator circuit according to claim 9, wherein the voltage regulator includes a differential amplifier circuit and a feedback circuit.

15. The regulator circuit according to claim 9, wherein the first terminal is not grounded.

16. A wireless tag comprising the regulator circuit according to claim 9.

17. A regulator circuit comprising:

a first terminal supplied with a first potential;

a second terminal having a second potential, wherein the first potential is different from the second potential;

a bias circuit including a first transistor, a second transistor, a third transistor, a fourth transistor, a resistor, and a bypass capacitor; and a voltage regulator electrically connected to the first terminal, the second terminal, and the bias circuit, wherein a gate of the first transistor is electrically connected to a gate of the second transistor, one of a source and a drain of the first transistor is electrically connected to the second terminal, and the other of the source and the drain of the first transistor is electrically connected to one of a source and a drain of the third transistor, wherein the gate of the second transistor is electrically connected to one of a source and a drain of the second transistor, and one of a source and a drain of the fourth transistor, and the other of the source and the drain of the second transistor is electrically connected to the second terminal, wherein a gate of the third transistor is electrically connected to the other of the source and the drain of the fourth transistor, and the other of the source and the drain of the third transistor is electrically connected to the first terminal, wherein a gate of the fourth transistor is electrically connected to the one of the source and the drain of the third transistor, wherein one terminal of the resistor is electrically connected to the gate of the third transistor, and the other terminal of the resistor is electrically connected to the first terminal, and wherein the bypass capacitor is provided between a node connected to the gate of the third transistor and one of the first terminal and the second terminal.

18. The regulator circuit according to claim 17, wherein the bypass capacitor is configured to prevent a change in a potential of the gate connected to the node where the bypass capacitor is provided.

19. The regulator circuit according to claim 17, wherein the bias circuit is configured to generate a reference potential on the basis of a potential difference between the first terminal and the second terminal; and wherein the voltage regulator is configured to output a potential to an output terminal on the basis of the reference potential generated by the regulator circuit.

20. The regulator circuit according to claim 17, wherein one of the third transistor and the fourth transistor is a single-gate transistor.

21. The regulator circuit according to claim 17, wherein one of the third transistor and the fourth transistor is a double-gate transistor.

22. The regulator circuit according to claim 17, wherein the voltage regulator includes a differential amplifier circuit and a feedback circuit.

23. The regulator circuit according to claim 17, wherein the first terminal is not grounded.

24. A wireless tag comprising the regulator circuit according to claim 17.

25. A regulator circuit comprising:

a first terminal supplied with a first potential;

a second terminal having a second potential, wherein the first potential is different from the second potential;

a bias circuit including a first transistor, a second transistor, a third transistor, a fourth transistor, a resistor, a first bypass capacitor, a second bypass capacitor, and a third bypass capacitor; and a voltage regulator electrically connected to the first terminal, the second terminal, and the bias circuit, wherein a gate of the first transistor is electrically connected to a gate of the second transistor, one of a source and a drain of the first transistor is electrically connected to the second terminal, and the other of the source and the drain of the first transistor is electrically connected to one of a source and a drain of the third transistor, wherein the gate of the second transistor is electrically connected to one of a source and a drain of the second transistor, and one of a source and a drain of the fourth transistor, and the other of the source and the drain of the second transistor is electrically connected to the second terminal, wherein a gate of the third transistor is electrically connected to the other of the source and the drain of the fourth transistor, and the other of the source and the drain of the third transistor is electrically connected to the first terminal, wherein a gate of the fourth transistor is electrically connected to the one of the source and the drain of the third transistor, wherein one terminal of the resistor is electrically connected to the gate of the third transistor, and the other terminal of the resistor is electrically connected to the first terminal, wherein the first bypass capacitor is provided between a node connected to the gate of the fourth transistor and one of the first terminal and the second terminal, wherein the second bypass capacitor is provided between a node connected to the gate of the first transistor and one of the first terminal and the second terminal, and wherein the third bypass capacitor is provided between a node connected to the gate of the third transistor and one of the first terminal and the second terminal.

26. The regulator circuit according to claim 25, wherein the first bypass capacitor is configured to prevent a change in a potential of the gate of the fourth transistor connected to the node where the first bypass capacitor is provided, the second bypass capacitor is configured to prevent a change in a potential of the gate of the first transistor connected to the node where the second bypass capacitor is provided, and the third bypass capacitor is configured to prevent a change in a potential of the gate of the third transistor connected to the node where the third bypass capacitor is provided.

27. The regulator circuit according to claim 25, wherein the bias circuit is configured to generate a reference potential on the basis of a potential difference between the first terminal and the second terminal, and wherein the voltage regulator is configured to output a potential to an output terminal on the basis of the reference potential generated by the regulator circuit.

28. The regulator circuit according to claim 25, wherein one of the third transistor and the fourth transistor is a single-gate transistor.

29. The regulator circuit according to claim 25, wherein one of the third transistor and the fourth transistor is a double-gate transistor.

30. The regulator circuit according to claim 25, wherein the voltage regulator includes a differential amplifier circuit and a feedback circuit.

31. The regulator circuit according to claim 25, wherein the first terminal is not grounded.

32. A wireless tag comprising the regulator circuit according to claim 25.

33. A semiconductor device comprising:

a semiconductor integrated circuit including a regulator circuit;

a support provided at least over a surface of the semiconductor integrated circuit; and a shield provided at least over the surface of the semiconductor integrated circuit with the support interposed therebetween, wherein the regulator circuit comprises:

a first terminal supplied with a first potential;

a second terminal having a second potential, wherein the first potential is different from the second potential;

a bias circuit including a first transistor, a second transistor, a third transistor, a fourth transistor, a resistor, and at least one bypass capacitor; and a voltage regulator electrically connected to the first terminal, the second terminal, and the bias circuit, wherein a gate of the first transistor is electrically connected to a gate of the second transistor, one of a source and a drain of the first transistor is electrically connected to the second terminal, and the other of the source and the drain of the first transistor is electrically connected to one of a source and a drain of the third transistor, wherein one of a source and a drain of the second transistor is electrically connected to the second terminal, the other of the source and the drain of the second transistor is electrically connected to one of a source and a drain of the fourth transistor, the gate of the second transistor is electrically connected to the other of the source and the drain of the second transistor, wherein a gate of the third transistor is electrically connected to the other of the source and the drain of the fourth transistor, and the other of the source and the drain of the third transistor is electrically connected to the first terminal, wherein a gate of the fourth transistor is electrically connected to the one of the source and the drain of the third transistor, wherein one terminal of the resistor is electrically connected to the gate of the third transistor, and the other terminal of the resistor is electrically connected to the first terminal, and wherein a bypass capacitor is provided between a node connected to at least one of gates of the first transistor, the second transistor, the third transistor, and the fourth transistor and one of the first terminal and the second terminal.

34. The semiconductor device according to claim 33, wherein the support is a resin film or a structural body in which a fiber is impregnated with a resin.

35. The semiconductor device according to claim 33, wherein the shield is made of a conductive material.

36. The semiconductor device according to claim 33, wherein the bypass capacitor has a capacitance larger than a parasitic capacitance generated between the node where the bypass capacitor is provided and the shield.

37. The semiconductor device according to claim 33, wherein the first terminal is not grounded.

38. A wireless tag comprising the semiconductor device according to claim 26.

* * * * *

UNITED STATES PATENT AND TRADEMARK OFFICE

CERTIFICATE OF CORRECTION

PATENT NO. : 8,587,286 B2
APPLICATION NO. : 12/686579
DATED : November 19, 2013
INVENTOR(S) : Hiroki Inoue et al.

It is certified that error appears in the above-identified patent and that said Letters Patent is hereby corrected as shown below:

In the Specification:

Column 1, line 63; Change "RFD)" to --RFID--.
Column 17, line 1; Change "Silicon" to --silicon--.
Column 24, line 60; Change "RFD)" to --RFID--.

In the Claims:

Column 32, line 23, Claim 38; Change "claim 26." to --claim 33.--.

Signed and Sealed this
Twenty-fifth Day of March, 2014

Michelle K. Lee

Michelle K. Lee
*Deputy Director of the United States Patent and Trademark Office*